US009340220B2

(12) United States Patent
Fries et al.

(10) Patent No.: US 9,340,220 B2
(45) Date of Patent: May 17, 2016

(54) SYSTEMS AND METHODS FOR MANAGEMENT OF CROSSINGS NEAR STATIONS

(71) Applicant: General Electric Company, Schenectady, NY (US)

(72) Inventors: Jeffrey Michael Fries, Melbourne, FL (US); Steven Ray Murphy, Melbourne, FL (US); Michael Steffen, II, Melbourne, FL (US); Jesse Lee Herlocker, Melbourne, FL (US); Nels Jorgensen, Melbourne, FL (US); Anuka Sawh, Melbourne, FL (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 220 days.

(21) Appl. No.: 13/900,649

(22) Filed: May 23, 2013

(65) Prior Publication Data

US 2014/0346284 A1 Nov. 27, 2014

(51) Int. Cl.

| | |
|---|---|
| ***B61L 13/00*** | (2006.01) |
| ***B61L 29/22*** | (2006.01) |
| *B61L 25/02* | (2006.01) |

(52) U.S. Cl.

CPC ..... *B61L 13/00* (2013.01); *B61L 29/22* (2013.01); *B61L 25/025* (2013.01); *B61L 2205/04* (2013.01)

(58) Field of Classification Search

CPC ..... B61L 29/00; B61L 29/08; B61L 29/18; B61L 29/22; B61L 29/24; B61L 29/28; B61L 29/30; B61L 29/32

USPC ..... 246/125, 126

See application file for complete search history.

(56) References Cited

U.S. PATENT DOCUMENTS

| | | | | |
|---|---|---|---|---|
| 5,864,304 | A * | 1/1999 | Gerszberg et al. | 340/903 |
| 6,824,110 | B2 | 11/2004 | Kane | |
| 7,089,093 | B2 | 8/2006 | Lacote | |
| 7,966,126 | B2 | 6/2011 | Willis | |
| 8,214,091 | B2 | 7/2012 | Kernwein | |
| 8,406,940 | B2 | 3/2013 | Otsubo | |
| 2007/0040070 | A1 * | 2/2007 | Stevenson et al. | 246/122 R |
| 2009/0177344 | A1 | 7/2009 | James | |
| 2009/0184214 | A1 * | 7/2009 | Reibeling et al. | 246/125 |
| 2009/0216395 | A1 * | 8/2009 | Kernwein | 701/20 |
| 2011/0084176 | A1 | 4/2011 | Reichelt | |
| 2012/0037761 | A1 * | 2/2012 | Bock et al. | 246/125 |
| 2012/0248261 | A1 * | 10/2012 | Nichter | 246/125 |

(Continued)

*Primary Examiner* — Zachary Kuhfuss

(74) *Attorney, Agent, or Firm* — The Small Patent Law Group LLC; Christopher R. Carroll

(57) ABSTRACT

A system includes a determination module and a communication module. The determination module is configured to be located onboard a first vehicle that travels along a first route including a crossing corresponding to an intersection of the first route with a second route. The determination module is configured to be communicatively coupled with a remote crossing module that is configured to impede travel of a second vehicle through the crossing, and to identify an upcoming stop at a station within a range of a track detection system associated with the remote crossing module. The communication module is configured to communicatively couple the determination module to the remote crossing module, and to transmit an inhibit request message to the remote crossing module. The inhibit request message is configured to prevent the remote crossing module from activating a warning when the first vehicle is stopped at the station.

18 Claims, 5 Drawing Sheets

(56) References Cited

U.S. PATENT DOCUMENTS

| | | | | |
|---|---|---|---|---|
| 2013/0015297 | A1* | 1/2013 | Steffen et al. | 246/125 |
| 2013/0270395 | A1* | 10/2013 | Steffen et al. | 246/125 |
| 2014/0166820 | A1* | 6/2014 | Hilleary | 246/125 |
| 2014/0191090 | A1* | 7/2014 | Busse et al. | 246/126 |
| 2014/0350767 | A1* | 11/2014 | Fries | 701/23 |
| 2014/0361125 | A1* | 12/2014 | Fries et al. | 246/473.1 |
| 2014/0361126 | A1* | 12/2014 | Steffen et al. | 246/473.1 |
| 2014/0365160 | A1* | 12/2014 | Steffen et al. | 702/122 |
| 2014/0367526 | A1* | 12/2014 | Steffen et al. | 246/126 |
| 2015/0192636 | A1* | 7/2015 | Fries et al. | 324/511 |

* cited by examiner

SYSTEMS AND METHODS FOR MANAGEMENT OF CROSSINGS NEAR STATIONS

FIELD

Embodiments of the subject matter described herein relate to vehicle location systems and methods, and more particularly, to systems and methods for providing warnings at grade crossings.

BACKGROUND

A rail vehicle transportation system may include tracks over which rail vehicles travel. These tracks may cross routes of other transportation systems, such as road or highway systems over which automobile and/or pedestrian traffic may pass. To prevent collisions between rail vehicles and automobiles, crossing gates may be provided at locations where the tracks intersect roads, with the crossing gates configured to impede automobiles from crossing the tracks while a rail vehicle is traveling on the tracks at or near the crossing.

Some known railroad crossings use a warning predictor track circuit that detects motion of a train towards the crossing. Warning predictors may calculate the time of train arrival at the crossing based on the detected motion, and activate the crossing warning devices (lights, gates, bells, or the like) a specified minimum amount of time prior to train arrival at the crossing. The minimum amount of time may be set by a government regulation, or set to exceed a government regulation. Crossing predictors are commonly used where there are mixed train types (freight, passenger, or the like) and/or where train speeds vary dramatically.

In some systems, for example rail systems that use catenaries or third rails to provide energy to rail vehicles, electrical interference may be too high for predictor systems to function accurately. Thus, in some applications, crossing gates or lights may be activated based on train occupancy within a given distance of a crossing, without respect to relative speed or arrival time of a train at a crossing. If track circuits that simply activate the crossing based on train occupancy are used (as opposed to detecting train motion), the warning times provided at the crossing can vary significantly depending upon train speed. Long warning times are undesirable because of the unnecessary delay caused to motorists, and also because overly long warning times may tempt impatient motorists to drive around crossing gates and/or disregard audible or visible warnings if the motorists do not see any trains approaching after some period of time.

Stations for train stops for picking up or dropping off passengers may be positioned near crossings, for example, to allow passengers to park close to the station. Areas of track monitored by track detection circuits for train movements and/or occupancy may be referred to as an approach and an island. The island may be tens or hundreds of feet on either side of a crossing (e.g., a crossing spanning the width of a road or highway). The approach, in turn, may be hundreds or thousands of feet on either side of the crossing (positioned outward of the island with respect to the highway). Problems, difficulties, or shortcomings associated with crossing operation may be exacerbated in situations where stations at which a vehicle (e.g., train) will stop are close to a crossing.

Crossing warnings may be activated various different ways in response to information from track detection circuits. For example, some track circuits may activate a crossing warning as soon as the approach is occupied. As another example, some track circuits may activate the crossing warning when motion is detected within the approach. As one more example, other track circuits may activate a crossing warning when a measured or determined motion indicates that a train will arrive at a given crossing in a prescribed amount of time (e.g., 20 seconds). Such systems have a number of shortcomings when a train stops at a station within the range of the detection circuits.

For example, if a crossing warning is activated due to train occupancy, the crossing warning will be activated the entire time the train is within the range of the detector circuit, even when the train is stopped at a station. As a result, traffic along a highway through the crossing may be stopped unnecessarily while the train dwells or remains at the station. Further, such a long warning time may tempt or encourage motorists to drive around the crossing gates, especially if the motorists see a stopped train. This results in a dangerous situation as, for example, trains may be approaching the crossing on adjacent tracks from the same or different direction.

As another example, if a crossing is equipped with a track detection circuit that activates the crossing due to train motion in the approach (and/or based on an estimated speed, distance, or arrival time at a crossing of a train detected within the approach), the warning device (e.g., a gate) may activate when the train enters the approach and subsequently deactivate when the train stops at the station. The repeated raising and lowering of a gate without a train passing through the crossing may confuse motorists and result in unsafe driving behavior. Further, the activation and deactivation may result in gate pump (e.g., raising the gate after a lowering has been initiated but before the lowering has completed), which may result in excessive wear on the crossing gate mechanism.

Further still, such track detection circuits or systems may be unable to detect the presence or movement of a train in time to activate a crossing warning after the train leaves the station. For example, if the station is close to the crossing, the train may arrive before the warning is fully activated or before a sufficient warning time has elapsed. Presently, when a train leaves a station within a detection range of a track detection system, the operator may move the train slowly toward the crossing until the detection of motion or detection of occupancy (e.g., occupancy within the island) may activate the crossing warning device, at which point the train may then proceed through the crossing. However, the island may have a range extending a short distance (e.g., tens of feet) from a highway or road. Thus, a train may be moving toward a highway or road a short distance from the highway or road with a crossing warning not activated. Motorists crossing the tracks and seeing a nearby train moving towards them may have a panic reaction and cause an accident.

Further still, federal (or other) regulations may require a minimum warning time before a train passes through a crossing. For example, the United States presently requires provision of a minimum of 20 seconds warning time (defined as the time from the start of a crossing warning to when the train occupies a highway). Presently, this warning time may be violated by operator error, for example, if an operator does not wait a sufficient amount of time before traversing a crossing.

BRIEF DESCRIPTION

In an embodiment, a system includes a determination module and a communication module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

The determination module is configured to be located onboard a first vehicle configured to travel along a first route. The first route includes a crossing corresponding to an intersection of the first route with a second route. The determination module is configured to be communicatively coupled with a remote crossing module that is configured to control a warning system to impede travel of a second vehicle along the second route through the crossing when the first vehicle is proximate to the crossing on the first route. In various embodiments, with respect to the operation of the warning system to impede travel through the crossing, the first vehicle may be understood to be proximate the crossing when the first vehicle is within a specified distance or time (e.g., 30 seconds) of a crossing. For example, a standard or regulation may prescribe a time for which a crossing warning is to be operated before a vehicle arrives at a crossing, and the specified distance or time may correspond to the prescribed time (e.g., may be the same as the prescribed time, or may be a longer period of time to provide a margin of error). The determination module is configured to identify an upcoming stop at a station within a range of a track detection system associated with the remote crossing module. The communication module is configured to communicatively couple the determination module to the remote crossing module, and is configured to transmit one or more inhibit request messages to the remote crossing module. The one or more inhibit request messages are configured to prevent the remote crossing module from activating the warning system when the first vehicle is approaching or stopped at the station.

In an embodiment, a system includes a remote crossing module configured to be disposed along a first route along which a first vehicle is configured to travel. The first route includes a track and a crossing corresponding to an intersection of the first route with a second route. The remote crossing module is configured to control a warning system configured to impede travel of a second vehicle along the second route through the crossing when the first vehicle is proximate to the crossing on the first route. The remote crossing module includes an automatic closure module and a communication module. The automatic closure module is configured to activate the warning system configured to impede travel of the second vehicle along the second route using information obtained from a track detection system configured to detect signals sent via the track. The communication module is configured to communicatively couple the remote crossing module to the first vehicle, and to receive one or more inhibit request messages from the first vehicle corresponding to a stop by the first vehicle at a station disposed within a range of the track detection system. The remote crossing module is configured to prevent activation of the warning otherwise indicated by the information obtained from the track detection system responsive to receiving the one or more inhibit request messages.

In an embodiment, a method includes determining, at one or more processing units disposed onboard a first vehicle configured to travel along a first route, an upcoming stop at a station that is disposed within a range of a track detection system of a crossing. The crossing corresponds to an intersection of the first route with a second route. The method also includes communicating one or more inhibit request messages to a remote crossing module disposed along the first route proximate the crossing. The one or more inhibit request messages are prepared at the one or more processing units, and are configured to prevent activation of a crossing warning activity at the crossing otherwise called for by information from the track detection system. The remote crossing module is configured to impede travel of a second vehicle along the second route through the crossing based on the information from the track detection system.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
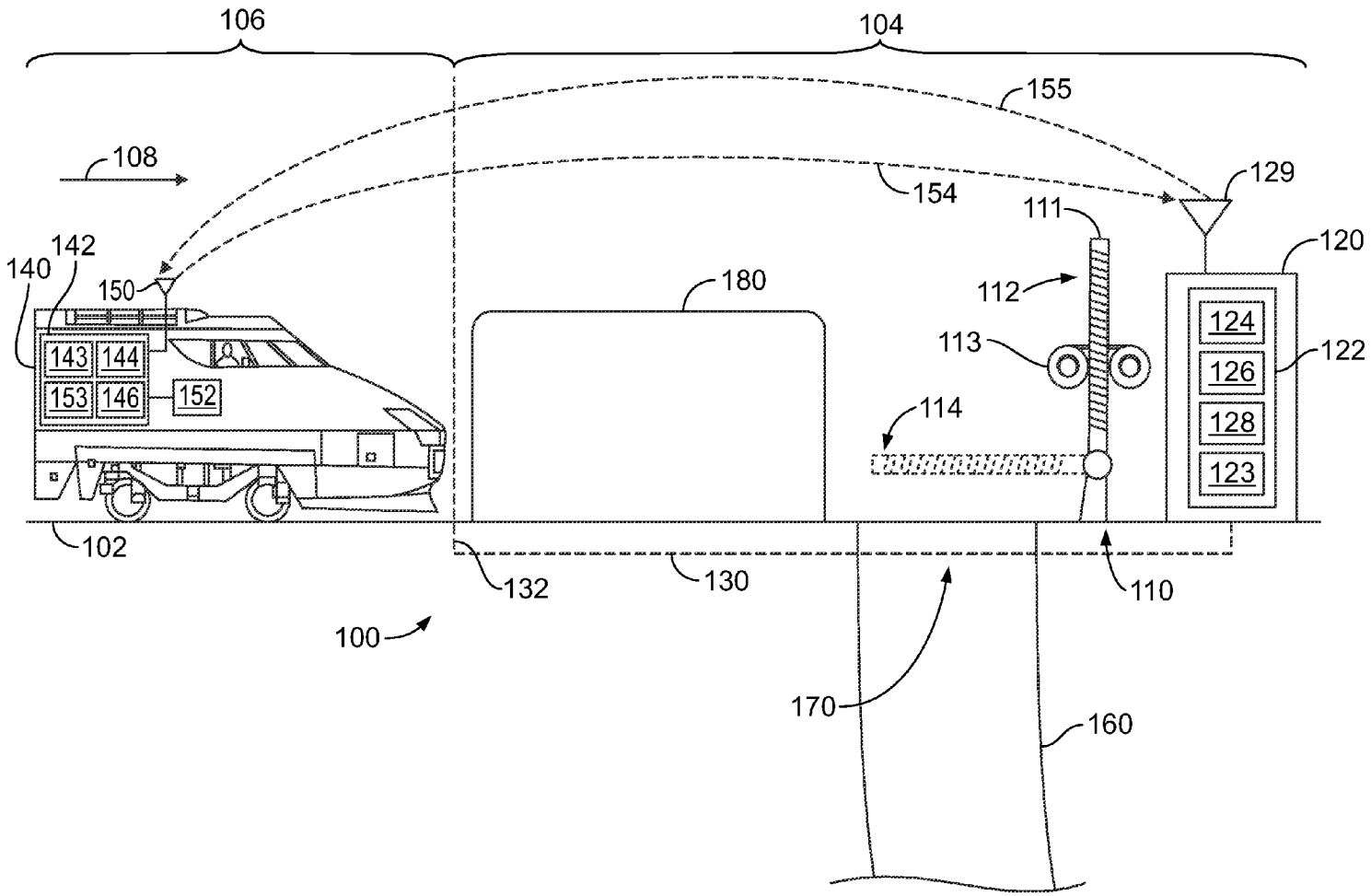
FIG. 1 is a schematic view of a transportation system in accordance with an embodiment.

One or more embodiments of the inventive subject matter described herein provide systems and methods for improved operation of crossings for transportation systems, such as crossings associated with an intersection between a rail system and a road or highway system. In various embodiments, an onboard system is provided that is configured to control movement of a vehicle, such as a rail vehicle, and to communicate with a remote crossing module, such as wayside equipment controlling the crossing. The control systems for the rail vehicle, for example, may be configured to be compatible with Positive Train Control (PTC) systems utilized in the United States. In various embodiments, bidirectional communications between onboard equipment and wayside equipment may be used to activate and deactivate crossing warning (or closing) systems only when necessary to provide a substantially consistent amount of warning time, as well as to eliminate or reduce gate pumping.

In various embodiments, an onboard system (e.g., a system disposed onboard the rail vehicle) may be utilized to send a message to wayside equipment controlling a nearby crossing that indicates that the rail vehicle will stop at an upcoming station that is within range of a track detection system utilized by the wayside equipment controlling the crossing. The message may include, for example, information such as a rail vehicle identifier, crossing identifier, track identifier, and/or direction of travel.

The onboard equipment of the rail vehicle may utilize one or more of a variety of techniques to determine that the rail vehicle will stop at a particular station. For example, the onboard equipment may use location determination equipment (e.g., global positioning systems (GPS), radio frequency identification (RFID) tags, or the like) to determine the rail vehicle's location relative to one or more stations. The station locations at which the rail vehicle will stop may be stored in an onboard memory. For example, the station locations may be described, depicted, or otherwise identified as part of a trip plan, schedule, or the like. The station locations may be stored in a database of an onboard memory module. Alternatively or additionally, the locations of stations at which the rail vehicle will stop may be transmitted to the rail vehicle. For example, an operator and/or control system of a rail vehicle may receive a message or order from a dispatcher to stop at a particular station (or stations). As another example, the rail vehicle may receive signals from wayside equipment indicating a station or stations at which the rail vehicle is to stop.

In various embodiments, when the wayside equipment controlling the crossing receives the message from the rail vehicle (e.g., from a communication module of onboard equipment of the rail vehicle) indicating that the rail vehicle will be stopped at the station within detection range, the wayside equipment inhibits activation of the crossing warning otherwise called for by detection of the rail vehicle. The onboard equipment may have a control module configured to positively enforce the stop at the station. In various embodiments, inhibition of the crossing warning as described herein prevents crossing warning devices from being activated unnecessarily while a rail vehicle is stopped at a station.

In various embodiments, safeguards may be provided against a failure potentially causing the crossing warning device to be permanently deactivated or otherwise compromised due to a loss of communication between the rail vehicle and wayside equipment. For example, the onboard equipment of the rail vehicle may periodically send, at a predetermined rate, the request or message to inhibit activation of crossing warning equipment. Further, the wayside equipment may utilize a predetermined timeout, so that if the wayside equipment does not continue to receive the request or message from the rail vehicle within the predetermined timeout, the wayside equipment will automatically activate the crossing warning if indicated by detection equipment. It should be noted that the message or request to inhibit activation of a crossing warning may be sent by a rail vehicle before the rail vehicle enters a detection range of wayside equipment that operates the crossing warning. With the inhibit message communicated before entry of the rail vehicle into the detection range, gate pump may be avoided.

Further, in various embodiments, information such as track identification (e.g., identification of a particular track or subroute upon which the rail vehicle approaching the station is traveling, or upon which the rail vehicle will traverse the crossing) or direction of travel may be provided by a first vehicle that is to stop at a station. Such information may be utilized by a crossing warning system to identify if a detected movement or presence is attributable to a different second vehicle instead of the first vehicle, and to operate the crossing warning system accordingly (e.g., to ignore or override an inhibit request if a different vehicle that will not stop at a station is approaching the crossing).

Various embodiments also provide for improved operation of crossing warnings associated with departure of vehicles from a station within a detection range of crossing warning systems. For example, in various embodiments, before a rail vehicle departs from a station disposed within a detection range of a track detection system, the rail vehicle (e.g., a communication module disposed onboard the rail vehicle) may send a message to wayside equipment controlling a nearby crossing that indicates that the rail vehicle will be leaving the station. The message may include, for example, information such as a train identifier, a crossing identifier, a track identifier, direction of travel, or the like.

The rail vehicle (e.g., an onboard processing unit of the rail vehicle) may determine whether or not the rail vehicle is to leave the station by one or more of a variety of techniques. For example, the rail vehicle may receive a manual request from an operator to depart a station. As another example, the rail vehicle may utilize a timer and send a message corresponding to station departure based on amount of dwell time at a station. As one more example, the onboard equipment may receive a signal or other message from wayside equipment instructing the rail vehicle when the rail vehicle may be permitted or prohibited from exiting a station (e.g., a rail vehicle may be prohibited from leaving a station based on the presence or travel of a different rail vehicle, an obstruction on the track, a detected safety concern, or the like).

After the wayside equipment receives the message regarding station departure from the rail vehicle that is stopped at the station, the wayside equipment may transmit an acknowledgement message to the rail vehicle indicating that the wayside equipment has received the request. The acknowledgement message may include, for example, train identification information, crossing identification information, track identification information, direction of travel information, activation status of the crossing, desired preemption and/or warning time information, or the like. The desired preemption or warning time, for example, may correspond to a time period for which the rail vehicle is prohibited from leaving the station to allow a crossing warning adequate time to activate (e.g., to satisfy a required pre-arrival warning time before the rail vehicle arrives at the crossing). The desired preemption or warning time may include a specified time at which the rail vehicle is authorized to leave the station. In various embodiments, onboard equipment (e.g., a control module) of the rail vehicle may use the preemption or warning time information to prevent departure of the rail vehicle from a station and/or arrival of the rail vehicle at a crossing before a desired time (e.g., a controller may override any operator attempt to move rail vehicle before allowed departure time). Thus, in various embodiments, crossing gates may be lowered for a desired amount of time before a rail vehicle departing a station arrives at the crossing, a consistent warning time may be provided, and motorists may not be subjected to a train moving toward the motorists while the motorists cross tracks.

A technical effect of embodiments includes reduction of delays in operating crossing activation systems. A technical effect of embodiments includes improved consistency in warning times provided at crossings, for example for rail vehicles that stop at a station near a crossing. A technical effect of embodiments includes reduction of duration of warning times, inconvenience, and/or confusion to motorists or others at a crossing. A technical effect of embodiments is the reduction of temptation to motorists to drive around a closed gate at a crossing, disregard a warning provided at a crossing, or engage in other unsafe behavior. A technical effect of embodiments is the reduction of accidents at crossings. A technical effect of embodiments is the prevention or reduction of activation of crossing warnings due to vehicles stopped at a station. A technical effect of embodiments is the prevention or reduction of crossing gate pump, including reduction of associated maintenance or replacement costs for crossing gate mechanisms. A technical effect of embodiments is improved safety at crossing, including reduced reliance on operator judgment to avoid accidents at crossing for which a crossing gate may not have otherwise activated.

Throughout this document, the term vehicle consist may be used. A vehicle consist is a group of any number of vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist may also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, may have sub-consists. Specifically, there may be a lead consist (of propulsion or non-powered control units), and one or more remote consists (of propulsion or non-powered control units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit may control the operations of the trail or remote propulsion units, even though the lead propulsion unit may or may not be disposed at a front or leading end of the vehicle consist along a direction of travel. A vehicle consist may be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

FIG. 1 depicts a schematic view of a transportation system 100 in accordance with an embodiment. The system 100 includes a crossing warning system 110, a remote crossing module 120, a track detection system 130, a vehicle system 140, and a station 180. The station 180 is configured as a location at which the vehicle system 140 may stop, for example to allow passengers off and/or to allow additional passengers to board the vehicle system 140. In the embodiment depicted in FIG. 1, the vehicle system 140 is shown traveling over a first route 102 in a direction 108 toward a crossing 170. The crossing 170 corresponds to intersection of the first route 102 with a second route 160. The first route 102, for example, may be configured as a railroad track over which a rail vehicle may travel. The second route 160 in the illustrated embodiment is a road or highway that is paved, leveled, or otherwise configured for automobile and/or pedestrian travel. In some embodiments, the crossing may be understood as a "highway crossing at grade."

The crossing warning system 110 and the remote crossing module 120 are associated with and disposed proximate the crossing 170. The crossing warning system 110 and the remote crossing module 120 are configured to impede access (and/or control impeding of access) through the crossing 170 via the second route 160 (e.g., paved road accessible to automobiles) when the vehicle system 140 passes by or through the crossing 170 along the first route 102 (e.g., rail system).

The track detection system 130 depicted in FIG. 1 has an effective range 104. In FIG. 1, the vehicle system 140 is depicted in a territory 106 outside of the effective range 104 and moving in direction 108 toward the crossing 170 and toward entering the effective range 104 of the track detection system 130. Further, in the illustrated embodiment, the station 180 is disposed within the range 104, with the vehicle system 140 traveling in direction 108 and scheduled to make a stop at the station 180 before proceeding to the crossing 170. For example, the vehicle system 140 may include a rail vehicle consist, for example, a passenger train, with the vehicle system 140 stopping at the station 180 to allow some passengers off while taking additional passengers on.

It should be noted that FIG. 1 is schematic in nature and intended by way of example. In various embodiments, various aspects or modules may be omitted, modified, or added. Further, various modules, systems, or other aspects may be combined. Yet further still, various modules or systems may be separated into sub-modules or sub-systems and/or functionality of a given module or system may be shared between or assigned differently to different modules or systems.

The depicted crossing warning system 110 is configured to impede travel through the crossing 170 along the second route 160 when the crossing warning system 110 is activated. The crossing warning system 110, when activated, may provide one or more of an audible warning (e.g., bell), visible warning (e.g., flashing lights), and/or a physical barrier (e.g., gate). In the illustrated embodiment, the crossing warning system 110 includes a gate 111 that may be raised to an open position 112 to allow traffic through the crossing 170 along the second route 160 or lowered to a closed position 114 to impede traffic through the crossing 170 along the second route 160. The depicted crossing warning system 110 also includes a crossing warning indicator 113 configured to provide a visual and/or audible indication. In various embodiments, the crossing warning indicator 113 may include one or more of lights, bells, or the like. In some embodiments, as used herein, impeding travel along a particular route may not present an absolute bar to travel along the route. For example, travel along a route may be impeded by warning against travel through a crossing, discouraging travel through a crossing, blocking travel through a crossing, instructing against travel through a crossing, or otherwise inhibiting travel through a crossing. For instance, the gate 111 may be placed in the closed position 114 to impede the passage of traffic through the crossing 170 along the second route 160; however, a motorist may attempt to evade the gate 111 by driving around the gate 111. Similarly, a motorist may ignore warning bells or lights. Various embodiments provide improved consistency in warning times to reduce the temptation of motorists to evade or ignore a crossing warning.

In the illustrated embodiment, the remote crossing module 120 is disposed along the route 102 along which the vehicle 140 is configured to travel proximate to the crossing 170. The remote crossing module 120 is operably connected to the crossing warning system 110 and is configured to operate the crossing warning system 110 to allow traffic through the crossing 170 along the second route 160 when no vehicles are traversing through the crossing 170 along the first route 102 (or are within a specified time and/or distance of the crossing 170), and to impede traffic through the crossing 170 along the second route 160 when a vehicle is traversing through the crossing 170 along the first route 102 (or is within a specified time and/or distance of the crossing 170). The remote crossing module 120 may operate the crossing warning system 110 based on instructions or information received from one or more of the vehicle system 140 or the track detection system 130. The remote crossing module 120 depicted in FIG. 1 includes a processing unit 122 and an antenna 129. In various embodiments, the remote crossing module 120 may be configured as wayside equipment.

The processing unit 122 of the illustrated embodiment includes a communication module 124, a crossing determination module 126, an automatic closure module 128, and a memory 123. The communication module 124 is configured to receive messages from and/or transmit messages to the vehicle system 140 via the antenna 129. The crossing determination module 126 is configured to determine a departure time for the vehicle system 140 from the station 180 corresponding to a time at which the remote crossing module 120 will have sufficient time to activate the crossing warning system 110. The automatic closure module 128 is configured to activate the crossing warning system 110 using information obtained from the track detection system 130. It should be noted that FIG. 1 is intended by way of example and is schematic in nature. In various embodiments, various modules (or portions thereof) of the processing unit 122 may be added, omitted, arranged differently, or joined into a common module, various portions of a module or modules may be separated into other modules or sub-modules and/or be shared with other modules, or the like.

The communication module 124 is configured to communicate messages or information with the vehicle system 140. The communication module 124 may be configured to one or more of receive messages, transmit messages, pre-process information or data received in a message, format information or data to form a message, decode a message, decrypt or encrypt a message, compile information to form a message, extract information from a message, or the like. In the illustrated embodiment, the communication module 124 utilizes the antenna 129 to communicate with the vehicle system 140. For example, the communication module 124 may receive a message 154 via the antenna 129 transmitted from the vehicle system 140, and/or may transmit a message 155 via the antenna 129 to the vehicle system 140. As discussed herein, the message 154 may be transmitted before the vehicle system enters the range 104. Alternatively or additionally, the message 154 may be sent on a periodic repeated basis. In various embodiments, the message 154 may include information corresponding to one or more of an upcoming arrival at the station 180, an upcoming departure time to activate the crossing warning system 110, suppression of an activation of the crossing warning system 110 indicated by the track detection system 130, or identification of a sub-route upon which the vehicle system 140 is traveling.

The message 154 may include an inhibit request. For example, an onboard processing unit of the vehicle system 140 may determine that the vehicle system 140 is going to stop at the station 180. If the remote crossing module 120 activates the crossing warning system 110 when the vehicle system 140 enters the range 104 or otherwise before the vehicle system 140 stops at the station 180, then the warning will be active for an overly long time period and/or be activated and deactivated unnecessarily (e.g., gate pump). The inhibit request received by the communication module 124 may be utilized by the remote crossing module 120 to prevent an activation corresponding to the entry of the vehicle system 140 within the range 104 that is otherwise called for by information from the track detection system 130. In the illustrated embodiment, the vehicle system 140 may send the message 154 including an inhibit request before the vehicle system 140 enters the range 104. Responsive to the received inhibit request, the remote crossing module 120 may ignore information from the track detection system 130 or otherwise prevent or inhibit activation of the crossing warning system 110.

Further, in various embodiments, the remote crossing module 120 may be configured to provide one or more safeguards against inadvertent or otherwise inappropriate inhibition of a crossing activation called for by information from the track detection system 130. For example, the vehicle system 140 may be configured to transmit plural inhibit requests repeated at periodic intervals, and the remote crossing module 120 may determine if an inhibit request is received within a predetermined time period, or timeout. If no inhibit message is received within the predetermined time period or timeout, the remote crossing module 120 may cease to inhibit activation of the crossing warning system 110. For example, a portion of the remote crossing module 120 (e.g., the communication module 124, the crossing determination module 126, or the like) may be configured to determine if a crossing inhibit message or request has been received within a 20 second period. If no inhibit request is received in the 20 second period, the crossing warning system 110 may be activated or operated in accordance with any information received from the track detection system 130. If a valid inhibit request is received, the operation of the crossing warning system 130 may be inhibited for 20 seconds and a new timeout period commenced. Thus, if communication becomes compromised between the vehicle system 140 and the remote crossing module 120, the remote crossing module 120 will not be effectively "frozen" in an inhibit mode, and instead the crossing warning may be activated as appropriate based on information from the track detection system 130.

As another example, the inhibit request may include or have associated therewith identification information so that a corresponding inhibition activity is limited to the particular track or sub-route upon which the vehicle system 140 is traveling, and any appropriate crossing warnings corresponding to other vehicles are activated. In various embodiments, the inhibit request may include or have associated therewith one or more of train identification information, crossing identification information, track identification information, direction of travel information, or the like. In various embodiments, if the track detection system 130 detects the presence of a vehicle on a track or sub-route other than a track or sub-route identified as the track or sub-route upon which the vehicle system 140 (which is scheduled to stop at the station 180) is traveling, then the remote crossing module may ignore, override, or otherwise disregard an inhibit request from the vehicle system 140, and operate or activate the crossing warning system 110 as appropriate based on the presence and/or movement of a vehicle on the different track or sub-route.

The message 154 in various embodiments may include a release request that is transmitted from the vehicle system 140 to the remote crossing module 120 when the vehicle system 140 is stopped at the station 180 but preparing to depart. When stopped at the station 180, the vehicle system 140 (e.g., one or more processing units disposed onboard the vehicle system 140) may transmit a release request to the remote crossing module 120 when the vehicle system 140 is ready to leave the station. In various embodiments, the vehicle system 140 may determine readiness to leave the station 180 based on an amount of dwell time at the station 180, an operator input indicating readiness to leave the station 180, or the like. Responsive to receiving the release request, the remote crossing module 120 may override an inhibit request from the vehicle system 140, and activate the crossing warning system 110 in anticipation of the arrival of the vehicle system 140 at the crossing 170. As also discussed elsewhere herein, the remote crossing module 120 may determine a time of departure for the vehicle system 140 that will allow the crossing warning system to have been activated for a predetermined amount of time (in some embodiments, about 20 seconds)

before the vehicle system 140 arrives at the crossing 170. Further still, in embodiments where the remote crossing system 120 utilizes a timeout period to activate the crossing warning system 110 if a periodic inhibit request is not received, the activation of the crossing warning system 110 based on the failure to receive continued inhibit requests may act as a backup or redundant safety consideration if the release request is not received by the remote crossing module 120.

In the illustrated embodiment, the message 155 is transmitted from the communication module 124 of the crossing module 120 via the antenna 129 to the vehicle system 140, and is configured as an acknowledgement message. The acknowledgement message may include, for example, train identification information, crossing identification information, track identification information, direction of travel information, activation status of the crossing, nominal station dwell times, desired preemption and/or warning time information, or the like. For example, the acknowledgement message may confirm or acknowledge receipt of an inhibit request as described herein. Additionally or alternatively, the acknowledgement message may confirm or acknowledge receipt of a release request as described herein. The message 155 may confirm that an inhibit request or release request has been received, and may also specify whether or not the inhibit request or release request will be granted or complied with. Further, in some embodiments, the acknowledgement request may include additional information. As one example, an acknowledgement request transmitted responsive to a received inhibit request may indicate the length of a predetermined timeout, or the length of a timeout remaining or time of day before the crossing system will be activated. As another example, an acknowledgement request transmitted responsive to a received release request may include information corresponding to departure of the vehicle system 140 from the station 180 or other control of the vehicle system 140 to prevent the vehicle system 140 from arriving at the crossing 170 before the crossing warning system 110 has been activated for a predetermined amount of time. For example, the acknowledgement may include one or more of a permitted departure time of the vehicle system 140 from the station 180, a permitted maximum speed of the vehicle system 140 between the station 180 and the crossing 170, a permitted maximum acceleration of the vehicle system 140 between the station 180 and the crossing 170, a permitted arrival time of the vehicle system 140 at the crossing 180, or the like.

Thus, in various embodiments, one or more messages may be employed to prevent or reduce one or more of early departure of the vehicle system 140 from the station 180, violation of a regulated warning time for activation of the crossing warning system 110 before the vehicle system 140 arrives at the crossing 170, inconsistent warning times, approach of the vehicle system 140 toward vehicles (e.g., cars) or pedestrians traveling through the crossing 170 on the second route 160 before the crossing warning system 110 is activated, reliance on operator judgment during operation of the vehicle system 140 near the crossing 170, or the like.

In various embodiments, one or more of the message 154 or the message 155 may include timing information that includes a reference time corresponding to a time for impeding travel along the second route through the crossing. In various embodiments, the reference time may be a time at which the vehicle system 140 is permitted to leave the station 180 after sending a release request to the remote crossing module 120. In various embodiments, the reference time may be a time at which the remote crossing module 120 is to activate the crossing warning system 110 (e.g., a time a predetermined amount before the time at which the vehicle system 140 arrives at or passes through the crossing 170). In the illustrated embodiment, the reference time is an absolute time. An absolute time may be understood as a time specified in accordance with a synchronization scheme where other entities use the same scheme. For example, clocks associated with and/or accessible by both the vehicle system 140 and the remote crossing module 120 may be synchronized via a common precision time reference such as a time provided by a global positioning system (GPS) or NTP (Network Time Protocol). In contrast to an absolute time, a relative time may be understood as a time described with reference to a particular event (e.g., 30 seconds from a time of receiving a message, 20 seconds from a time of receiving a message, or the like).

In various embodiments, information regarding track occupancy, status of switches, or other information utilized, for example, in conjunction with a positive control system may be exchanged between the remote crossing module 120 and the vehicle system 140 (e.g. as part of one or more of message 154 and message 155). A positive train control system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a positive train control system may force a train to slow or stop based on the condition of a signal, switch, crossing, or the like that the train is approaching.

In various embodiments, the crossing determination module 126 is configured to determine an activation time to activate the crossing warning module 110, and/or to activate or deactivate the crossing warning module 110 based on the presence (or absence) of a vehicle traversing the first route 170 at or near the crossing 170 (e.g., within a specified closing or warning time or distance). Activation of the crossing warning system 110 may include one or more of closing a gate, providing flashing lights, sounding an alarm (e.g., bells), or the like. In various embodiments, the crossing determination module 126 may determine a time to activate (or deactivate) the crossing warning module 110 based on information received from one or more of the vehicle system 140 or the automatic closure module 128. For example, if no inhibit request is received (or not received within a timeout period), the crossing determination module 126 may determine a time to activate the crossing warning system 110 based on information received from the track detection system 130. As another example, if an inhibit request is received but contains track identification information indicating a vehicle on a first track, the crossing determination module 126 may determine a time to activate the crossing warning system 110 based on information received from the track detection system 130 corresponding to vehicles on other tracks.

In the embodiment depicted in FIG. 1, the crossing determination module 126 is configured to determine a departure time for the vehicle system 140 from the station 180 corresponding to a time at which the remote crossing module 120 will have sufficient time to activate the crossing warning system 110. For example, the crossing determination module 126 may determine a departure time responsive to receiving a release request from the vehicle system 140 while the vehicle system 140 is stopped at the station 180. The departure time may specify a time at which the vehicle system 140 is allowed to leave the station 180 that gives the remote crossing module 120 sufficient time to activate the crossing warning system 110 to give a warning at the crossing 170 for a predetermined amount of time before the vehicle system 140 arrives at the crossing 170.

For example, the crossing determination module 126 may determine an allowable departure time based on a distance from the station 180 to the crossing 170, capability of the vehicle system 140, required warning time for the crossing, or the like. Information regarding distance from the station, vehicle capability, required warning times, or the like may be stored in a database in the memory 123 of the remote crossing module 120 and/or communicated as part of a message 154. As one example, if the vehicle system 140 is capable of accelerating from the station 180 to the crossing 170 in 10 seconds, and the crossing warning system 110 is to be activated 20 seconds before the arrival of the vehicle system 140, then the permissible departure time may be determined as 10 seconds after the activation of the crossing warning system 110.

Alternatively or additionally, the crossing determination module 126 may determine an arrival time corresponding to a permitted time of arrival of the vehicle system 140 at the crossing 170 that provides the remote crossing module 120 sufficient time to activate the crossing warning system 110 for a predetermined amount of time before the arrival of the vehicle system 140 at the crossing 170. The departure time (and/or other timing information) may be transmitted to the vehicle system 140, for example, as a portion of a message 155 transmitted from the communication module 124.

The departure time (and/or other timing information) may be determined and/or transmitted to the vehicle system as a relative time in some embodiments (e.g., a given amount of time from reception), or as an absolute time in other embodiments. Further, satisfaction of the transmitted departure and/or arrival time may be enforced by an onboard control system of the vehicle system 140. In various embodiments, the crossing determination module 126 and/or the communication module 124 may be configured to determine if a timeout period for reception of inhibit requests has been satisfied or not, and to determine whether or not a warning activation indicated as appropriate by information received from the track detection system is to be overridden or ignored based on the reception (or lack of reception of an inhibit request message), and/or based upon track identification information in an inhibit request.

In the illustrated embodiment, the automatic closure module 128 is configured to impede travel along the second route 160 using information obtained from the track detection system 130. The automatic closure module 128 is operably coupled to and receives information from the track detection system 130, and operates the crossing warning system 110 using information from the track detection system 130. As discussed herein, the track detection system 130 (and/or the automatic closure module 128 in conjunction with the track detection system 130) may be configured to send an electrical signal into a track (e.g., route 102) and receive or detect a signal corresponding to an occupancy or activity on the track.

As discussed herein, in the illustrated embodiment, the automatic closure module 128 is operably coupled with the track detection system 130. Generally, in various embodiments, the automatic closure module 128 works in conjunction with the track detection system 130. The depicted automatic closure module 128 is configured to operate the crossing warning system 110 based on information detected using the track detection system 130. The automatic closure module 128, in conjunction with the track detection system 130 may be configured to close a gate or otherwise initiate a warning as a vehicle approaches the crossing 170 along the first route 102 and/or to open a gate or otherwise terminate a warning after a vehicle has passed through the crossing 170 along the first route 102. In some embodiments, the track detection system 130 may be configured as a crossing predictor system that provides information corresponding to both a position along the route 102 and a speed of the vehicle system 140. In some embodiments, the track detection system 130 may be configured as an occupancy detection system that only provides information regarding whether the vehicle system 140 is present along a given portion of the route 102 or not. In various embodiments, the automatic closure module 128 and/or the crossing determination module 126 may operate the crossing warning system according to information received from the track detection system 130 unless an inhibit request has been received.

As depicted in FIG. 1, the track detection system 130 has a range 104. In the illustrated embodiment, the track detection system 130 includes a detection element 132 that defines the boundary of the range 104. The detection element 132, for example, may be a shunt buried beneath a track and operably connecting adjacent rails for completing or defining a circuit for a signal sent via a crossing predictor system or directing the signal along a track or rail (e.g., route 102). The range 104 corresponds to the distance at which the track detection system is able to detect or determine the presence of the vehicle system 140. In FIG. 1, the range 104 is depicted for ease of illustration as extending in one direction (e.g., to the left of the crossing as seen in FIG. 1), but it should be understood that the range 104 may also extend in the opposite direction (e.g., to the right of the crossing as seen in FIG. 1) to provide for traffic detection in multiple directions.

As indicated above, the track detection system may be configured as a crossing predictor system. Crossing predictors may be used to attempt to determine a time of arrival at a crossing by a vehicle. Known crossing predictor systems may use alternating current (AC) track circuits to determine the rate of change of impedance in an area of track near a crossing. The area near the crossing may be referred to as an approach. Such an approach may be hundreds or thousands of feet on either side of a crossing. As a vehicle such as a train moves toward the crossing, the axles of the train act to shunt the AC track circuit signal, shortening the distance that the signal flows through. The crossing predictor (e.g., one or more portions or aspects of the track detection system 130 and/or automatic determination module 128) measures a rate of change of the electrical impedance indicated by the signal, and estimates the speed of location of the train based on the measured electrical impedance, and estimates a predicted arrival time of the vehicle at the crossing based on the determined speed and position, and a crossing warning device may then be activated at a predetermined time interval before the predicted arrival time. In other applications, motion detectors may be employed for the track circuit detection system 130. Motion detectors operate much like crossing predictors but do not measure the vehicle speed or estimate the time of arrival at the crossing 170, but simply activate the crossing warning system 110 based on the detection of vehicle motion within the range 104. Such systems may have difficulty providing consistent warning times when a vehicle (e.g., vehicle system 140) stops at a station (e.g., station 180) within the range 104. For example, a crossing predictor system may activate a warning (e.g., lower a gate) when the vehicle system 140 enters the range 104 (or based on a speed and estimated arrival of the vehicle system 140 determined when the vehicle system 140 enters the range 104). However, when the vehicle system 140 stops at the station 180, the crossing predictor system may then determine that the vehicle system 140 is stopped, and de-activate the warning (e.g., raise a gate). This can result in confusion to motorists waiting at or approaching the crossing 170 along the second route 160, and may also result in gate pump.

Further, if the station 180 is located too close to the crossing, the crossing predictor system may not be able to re-identify the vehicle system 140 as moving after the vehicle system 140 leaves the station 180 and activate the warning (e.g., lower a gate) an appropriate amount of time before the vehicle system 140 arrives at the crossing 170. If the crossing predictor system is unable to lower the gate in time after the vehicle system 140 leaves the station 180, avoidance of traffic along the second route 160 through the crossing 170 may be reliant upon an operator's ability to travel slowly to the crossing 170 until the crossing predictor system is able to activate the warning, and may result in additional confusion, unease, and/or risk to vehicles traveling along the second route 160. In various embodiments, premature lowering of the gates (and resulting raising of the gates when the vehicle system 140 is stopped at the station 180) may be avoided by the use of an inhibit request or requests transmitted from the vehicle system 140 to the remote crossing module 120 as the vehicle system 140 approaches the station 180 and/or stops at the station 180. Further, in various embodiments, premature arrival of the vehicle system 140 at the crossing 170 may be avoided by the use of timing information transmitted from the remote crossing module 120, and the use of such timing information to control (e.g., via an onboard control system that autonomously enforces a departure time from the station 180 and/or an arrival time at the crossing 170) the vehicle system 140.

Further still, crossing predictor systems do not function properly when a relatively large amount of electrical interference is present, such as electrical interference present in electrified systems. In such electrified systems, vehicles such as trains may be powered by AC or direct current (DC) power provided by an overhead catenary, third rail, or the like. The currents provided to power the vehicles may exceed hundreds or thousands of amperes, and are much larger than currents used by crossing predictor systems. The large difference in signal amplitudes between the electrification currents used to power vehicles and the currents used for crossing predictors may make it difficult to separate the signals. Further, interference frequencies from the electrification currents may, for example, cause activation via crossing predictors when no vehicles are present, leading to confused motorists and/or motorists evading crossing gates or engaging in other unsafe behavior. Also, in such electrification systems, there may be impedance bonds between adjacent rails configured to balance the flow of electrification currents between rails to improve safety by reducing hazardous voltages that may develop between the rails. Such impedance bonds may cause errors in the impedance calculations used by the crossing predictors used to predict arrival time of vehicles at the crossing. As a result, crossing predictors may not be employed in electrified territories.

Instead, electrified systems may employ occupancy detection circuits or systems. Such occupancy detection track circuits may detect the presence of a train or other vehicle along a route within a given distance of a crossing, but do not detect or determine information corresponding to a more precise position and/or speed of a vehicle. For such systems, a length of approach may be designed to provide the minimum desired or required amount of warning time at the maximum authorized vehicle speed. The length of approach may also be limited by practical considerations, such as the attenuation of a signal along the tracks. For such systems, a warning may be activated (e.g., a crossing gate lowered) once the track detection system 130 detects the presence of the vehicle system 140 within the range 104. However, if the vehicle system 140 stops at the station 180, the warning may be activated for an overly long period of time. Further, if motorists delayed at the crossing 170 observe the vehicle system 140 stopped at the station 180 while the crossing gate is down, some motorists may attempt to evade the crossing warning (e.g., drive around a gate).

Further still, if the occupancy detection system is unable to lower the gate in time after the vehicle system 140 leaves the station 180, avoidance of traffic along the second route 160 through the crossing 170 may be reliant upon an operator's ability to travel slowly to the crossing 170 until the occupancy detection system is able to activate the warning, and may result in additional confusion, unease, and/or risk to vehicles traveling along the second route 160. In various embodiments, premature lowering of the gates may be avoided by the use of an inhibit request or requests transmitted from the vehicle system 140 to the remote crossing module 120 as the vehicle system 140 approaches the station 180 and/or stops at the station 180. Further, in various embodiments, premature arrival of the vehicle system 140 at the crossing 170 may be avoided by the use of timing information transmitted from the remote crossing module 120, and the use of such timing information to control (e.g., via an onboard control system that autonomously enforces a departure time from the station 180 and/or an arrival time at the crossing 170) the vehicle system.

In various embodiments, the remote crossing module 120 may operate a crossing warning system in accordance with information received from a vehicle system when information (e.g., an inhibit request, a release request, or the like) is received from the vehicle system, and operate the crossing warning system in accordance with information received from a track detection system when information is not received from the vehicle system (e.g., if no inhibit request has been transmitted, if a communication module of the vehicle system or remote crossing module is not functioning properly, if a given vehicle system is not configured to provide information for operating the crossing warning system, if a given vehicle system travels on a track that has not been identified in an inhibit request, or the like).

The vehicle system 140 is configured to travel along the first route 102. In FIG. 1, the vehicle system 140 is positioned in the territory 106 outside of the range 104 of the track detection system 130, and is traveling in a direction 108 toward the crossing 170. The vehicle system 140 may be, for example, a rail vehicle. In the illustrated embodiment, the vehicle system 140 is depicted as a locomotive, however, the vehicle system 140 may be configured otherwise in other embodiments, for example as a rail vehicle consist, or, as another example, as a non-rail vehicle. In some embodiments, the vehicle system 140 may include an internal source, such as a diesel powered generating unit and/or battery, for providing motive force. In some embodiments, the vehicle system 140 may receive energy for providing motive force from an external power source disposed along the route 102, such as a third rail or overhead catenary. The vehicle system 140 depicted in FIG. 1 includes a processing unit 142, an antenna 150, and a position detection module 152.

The processing unit 142 is configured to be disposed onboard the vehicle system 140, and includes a memory 143, a station determination module 144, a control module 153, and a communication module 146. It should be noted that FIG. 1 is intended by way of example and is schematic in nature. In various embodiments, various modules (or portions thereof) of the processing unit 142 may be added, omitted, arranged differently, or joined into a common module, various portions of a module or modules may be separated into other modules or sub-modules and/or be shared with other modules, or the like.

The station determination module 144 is configured to determine the presence of an upcoming stop or otherwise identify an upcoming stop at a station that is within a range of track detection system associated with a remote crossing module. In the illustrated embodiment, the station determination module 144 is configured to identify an upcoming stop at the station 180 within the range 104 of the track detection system 130 of the crossing 170 and the remote crossing module 120. The station determination module 144 may determine such an upcoming stop using one or more of a variety of techniques. For example, the position of the vehicle system 140 may be determined using information from wayside equipment, using information from the position detection module 152, using onboard sensors such as a speedometer, odometer or the like to estimate a position, or the like. The position detection module 152, for example, may include one or more of a GPS detector, RFID detector, or the like. The position detection module 152 may also be configured to provide an absolute time reference to the processing module 142.

The position of the station 180, the position of the crossing 170, and/or the range 104 may be determined in various embodiments from one or more of information stored in a database (e.g., a database tabulating positions of crossings and stations along with ranges of track detection systems associated with corresponding crossings), information from a trip plan (e.g., information specifying which particular stations will be stopped at), information from the remote crossing module 120 or other wayside equipment (e.g., a message from the remote crossing module 120 identifying or specifying the range 104 of the track detection system 130, the position of the station 180, and/or the position of the crossing 170), or the like. Additionally or alternatively, a stop and/or a station at which a stop is to occur may be identified using operator input, an order or message from a dispatcher, or a message from wayside equipment associated with a PTC system requiring a particular stop. In various embodiments, the stop may be within the range of a track detection system but not at a station.

In various embodiments, the station determination module 144 may also determine when the vehicle system 140 is ready to leave the station 180. The vehicle system 140 may be determined as ready to leave the station 180, for example, responsive to an operator input, or as another example, based on amount of dwell time at the station 180.

Additionally or alternatively, the station determination module 144 (or other aspect of the processing module 142) may make additional determinations in various embodiments. In some embodiments, the station determination module 144 may determine a minimum time from the station 180 to the crossing 170 that the vehicle system 140 is capable of. For example, the remote crossing module 120 may transmit an acknowledgement of a release request previously transmitted by the vehicle system 140. Responsive to the receipt of the acknowledgement, the station determination module 144 may determine an amount of time it will take the vehicle system 140 to reach the crossing from the station 180. The amount of time may be based on speeds called for by a trip plan or profile, or as another example, the amount of time may be based on the maximum acceleration the vehicle system 140 is capable of. The amount of time from the station 180 to the crossing 170 may then be transmitted to the remote crossing module 120, and the remote crossing module 120 may then determine an appropriate departure time for the vehicle system 140, and transmit the departure time to the vehicle system 140. As another example, in various embodiments, the remote crossing module 120 may transmit, as part of an acknowledgement of a release request, a permissible arrival time at the crossing 170 based on a predetermined desired warning time. The crossing determination module 144 may determine a permissible departure time based on the permissible arrival time. In various embodiments, the permissible departure time may be enforced by a control module of the vehicle system 140.

The communication module 146 is configured to communicatively couple the vehicle system (e.g., the station determination module 144) to the remote crossing module 120. For example, the communication module 146 may receive information corresponding to an upcoming stop at the station 180 from the station determination module 144, compile and/or format the information into a message 154, and transmit the message 154 (via the antenna 150) to the communication module 124 of the remote crossing module 120 (via the antenna 129). In various embodiments, the communication module 146 may be configured to transmit an inhibit request message to the remote crossing module 120, with the inhibit request message configured to prevent the remote crossing module 120 from performing an activation of the crossing warning system 110 otherwise called for by the entrance of the vehicle system 140 within the range 104 when the vehicle system 140 is about to stop at or is stopped at the station 180. The communication module 146 may be configured to transmit the inhibit request before the vehicle system 140 enters the range 104.

Further, the communication module 126 may be configured to transmit plural inhibit request messages spaced a predetermined amount of time apart while the vehicle system 140 is approaching and/or stopped at the station 180. In some embodiments, the predetermined amount of time between the transmission of inhibit request messages may be configured to occur at least twice during a timeout period of the remote crossing module 120. For example, the length of the timeout period may be obtained from a database storing characteristics of crossings, stations, and/or remote crossing modules, and/or the length of the timeout may be may be obtained from a message transmitted from the remote crossing module 120 to the vehicle system 140 including information corresponding to the timeout period.

For example, the remote crossing module 120 may have a timeout period of 20 seconds. Thus, if 20 seconds elapse without receipt of an inhibit request message (while information from the track detection system 130 indicates the appropriateness of performing a crossing warning activity such as lowering a gate), the remote crossing module 120 will initiate a crossing warning activity. After the communication module 146 transmits an inhibit request to the remote crossing module 120, the remote crossing module 120 may transmit an acknowledgement of the inhibit request to the communication module 146, with the acknowledgement message including information describing the length of the timeout period (e.g., 20 seconds). Then, the communication module may determine an interval at which to send repeated inhibit requests. If it is desired that at least two inhibit request messages are sent within each timeout period of 20 seconds, the communication module 146 may determine the predetermined interval for sending inhibit request messages to be 10 seconds (or less) and, transmit inhibit requests (so long as inhibition of the crossing warning is called for by the processing unit 142) every ten seconds (or less). In other embodiments, other timeout periods or intervals may be employed.

Additionally or alternatively, the communication module 146 may be configured to transmit a release request to the remote crossing module 120. For example, after it has been determined (e.g., by the station determination module 144) that the vehicle system 140 is ready to leave the station 180, the communication module 146 may transmit a release request to the remote crossing module 120, thereby informing the remote crossing module 120 that the vehicle system 140 is ready to leave the station. As another example, the communication module 146 may transmit a release request pursuant to a manual input from an operator. For example, the operator may enter (via keyboard, stylus, mouse, or the like) an instruction or request to leave the station 180. As another example, the operator may actuate a button, switch, or the like to indicate readiness to leave the station 180. Responsive to receiving the release request, the remote crossing module 120 may then determine timing information corresponding to a permissible departure time for the vehicle system 140 from the station 180, and transmit an acknowledgement including the determined timing information to the communication module 146.

The communication module 146 may be configured to one or more of receive messages (e.g., messages from the remote crossing module 120), transmit messages, pre-process information or data received in a message, format information or data to form a message, decode a message, decrypt or encrypt a message, compile information to form a message, extract information from a message, or the like. For example, the communication module 146 may be configured to use information from the station determination module 144 to construct the message 154. In various embodiments, one or more of an inhibit request, release request, track identification information, or the like may be formatted into a message along with other message portions, such as a header, address, additional information, or the like. Various requests or types of information may be sent together as one message, or, as another example, may be sent as parts of separate messages. For example, an inhibit request message may include a header, address, or the like that identifies a particular vehicle, particular station at which the vehicle will stop, particular crossing, and/or particular track upon which the vehicle is traveling.

Further still, in various embodiments, the communication module 146 may be configured to transmit track or sub-route identification information to the remote crossing module. For example, in some areas, a transportation network may include multiple adjacent sub-routes or separate tracks, such that vehicle systems may travel generally parallel to each other. Thus, multiple adjacent sub-routes of a route 102 may each cross a second route (e.g., second route 160) at the same crossing 170. In such embodiments, a given remote crossing module 120 and/or crossing warning system 110 may be configured to provide a warning based on traffic along multiple sub-routes. Track identification information may be utilized by such a remote crossing module 120 to ensure that automatic closure activities are only suppressed or inhibited for a particular track upon which a vehicle sending suppression information is disposed. (See also FIG. 2 and related discussion.)

For instance, in one example scenario, the route 102 may comprise plural sub-routes (e.g., tracks running parallel to each other through the crossing 170, with each sub-route configured to accommodate travel by a vehicle when the other sub-routes are occupied with other vehicles). The inhibit request may include sub-route identification information corresponding to particular sub-route on which the vehicle system 140 is traveling. For instance, the route 102 may include tracks A, B, and C, with B identified as the sub-route or track upon which the vehicle system 140 is traveling. The identification information may be determined based on information provided at the outset of the mission and/or periodically updated as the vehicle system 140 performs a mission. With the vehicle system 140 identified as traveling on track B, if the automatic closure module 128 detects a vehicle on either of tracks A or C instead of track B, the automatic closure module 128 may operate the crossing warning system 110 to activate a warning (for example, the remote crossing module 120 may override the suppression information associated with a different track, or, as another example, the remote crossing module 120 may ignore the suppression information associated with a different track).

The control module 153 in the illustrated embodiment is configured to control operation of the vehicle system 140 in accordance with information provided by the remote crossing module 120 (e.g., information contained in the message 155). For example, after the vehicle system 140 transmits a release request message, the remote crossing module 120 may transmit an acknowledgement message including timing information corresponding to a permitted departure time from the station 180 for the vehicle system 140. The control module 153 in various embodiments is configured to enforce the permitted departure time. For example, the control module 153 may override any input from an operator corresponding to leaving the station 180 before the departure time. Further, one or more indications may be provided to the operator to indicate an appropriate time to leave the station. For example, a red light may be displayed before the permitted departure time, and a green light displayed at or after the permitted departure time. Additionally or alternatively, one or more audible signals may be provided to inform the operator if the departure time has been reached or not. Further additionally or alternatively, a textual or visual display may be provided. As one example, the permitted departure time may be displayed on a screen. As another example, a visible count-down to the departure time may be displayed on a screen to the operator.

In various embodiments, the control module 153 may obtain a permitted departure time (e.g., via the communication module 146 as determined by the remote crossing module 120), and enforce the departure time by controlling the vehicle system 140 to remain stopped at the station 180 until the departure time. As another example, the vehicle system 140 may receive a permitted arrival time at the crossing 170, determine (e.g., at one or more of the station determination module 144 or the control module 153) a corresponding departure time, and enforce the departure time. As one more example, the control module 153 may obtain a permitted arrival time at the crossing 170 and enforce a speed limit or otherwise control the speed of the vehicle system 140 between the station 180 and the crossing 170 so that the vehicle system 140 arrives at the crossing 170 at the appropriate time.

The control module 153 may be configured to perform additional control tasks, for example, control tasks that are performed autonomously without operator interference and/or are configured to override or ignore any inconsistent operator inputs. For example, after an inhibit request has been sent corresponding to a planned stop at the station 180, the control module 153 may enforce the stop by controlling the vehicle system 140 to stop at the station 180 and/or over-riding or ignoring an input by the operator inconsistent with such a stop. Additionally or alternatively, after departure from the station 180, the control module 153 may enforce a speed limit and/or acceleration limit to prevent the vehicle system 140 from arriving at the crossing 170 before a sufficient warning time has elapsed. In various embodiments, the control module 153 may be configured to receive positive train control signals from wayside equipment and to control the vehicle system 140 accordingly.

Figure 2:
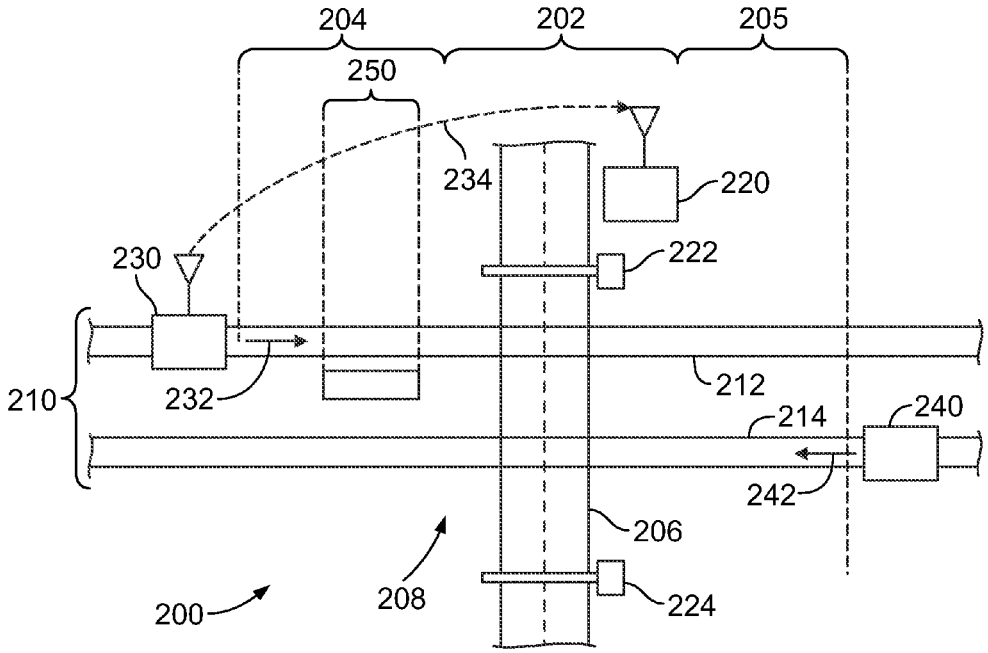
FIG. 2 is an overhead schematic diagram of a transportation network in accordance with an embodiment.

FIG. 2 provides an overhead schematic diagram of an embodiment of a transportation network 200 formed in accordance with an embodiment. The transportation network 200 is configured to utilize information communicated between one or more vehicle systems and a remote crossing module to provide consistent warning times for transportation networks including stations disposed within range of track detection systems, as well as to utilize automatic initiation of a warning based on information from a track detection system or circuit when appropriate. The transportation network 200 includes a first route 210 that includes generally parallel sub-routes 212 and 214. In the illustrated embodiment, each sub-route may be configured as a pair of tracks or rails configured for travel by a rail vehicle. In FIG. 2, a first rail vehicle 230 traverses the track 212 in a direction 232, and a second rail vehicle 240 traverses the track 214 in a direction 242. The rail vehicles 230, 240 may each be configured as, for example, a rail vehicle consist or another vehicle capable of self-propulsion. In various embodiments, the rail vehicles 230, 240 may receive power from a power source (not shown) disposed along the first route 210, such as a third rail or overhead catenary. Each of the depicted sub-routes or tracks 212, 214 intersect a second route 206 at a crossing 208. The transportation network 200 also includes crossing gates 222, 224 positioned on either side of the first route 210 along the second route 206. The crossing gates 222, 224 are configured to impede traffic along the second route 206 through the crossing 208 when activated. The transportation network 200 further includes a remote crossing module 220 configured to operate the crossing gate 222 and the crossing gate 224.

The network 200 also includes an island 202 interposed between approaches 204, 205. The island 202 corresponds to an area for which the crossing gates 222, 224 are configured to be closed whenever a vehicle is present along the first route 210, regardless of whether the vehicle is moving or whether the crossing warning system is inhibited. The approaches 204, 205 define areas within the range of a track detection system utilized by the remote crossing module 220. The network 200 further includes a station 250 disposed within the approach 204.

The remote crossing module 220 may determine when to activate (or de-activate) a warning in certain respects generally similar to the discussion herein regarding the embodiment depicted in FIG. 1. For example, the remote crossing module 220 may operate the crossing gates 222, 224 responsive to information received from a vehicle (e.g., rail vehicle 230) and/or responsive to information received from a track detection system (e.g., track detection system 130 discussed in conjunction with FIG. 1).

An example scenario illustrating the use of inhibit messages and track identification information will now be discussed in connection with FIG. 2. In the example scenario, the rail vehicle 230 is traveling toward the crossing 208 along the track 212 of the first route 210. The rail vehicle 230 is outside of the approach 204 and therefore beyond the range of the automatic closure module of the remote crossing module 220. The rail vehicle 240 is traveling toward the crossing 208 along the track 214 of the first route 210. The rail vehicle 240 is outside of the approach 205 and also beyond the range of the automatic closure module of the remote crossing module 220. In the example scenario, the rail vehicle 230 is scheduled to make a stop at the station 250. In the example scenario, the rail vehicle 240 is not scheduled to stop before passing through the crossing 208 at a station within range of a track detection system associated with the crossing 208.

In the illustrated embodiment, the rail vehicle 230 sends a message 234 to the remote crossing module. The message 234 includes an inhibit request message indicating that the rail vehicle 230 is traveling on the track 212 and will stop at the station 250. The remote crossing module 220 is configured to ignore or override information from a track detection system corresponding to the travel of the rail vehicle 230 to the station 250 and the stoppage of the rail vehicle 230 at the station 250.

As indicated above, the message 234 includes track identification information identifying track 212 as the sub-route upon which the rail vehicle 230 is traveling. For example, the track identification information may be obtained by the rail vehicle 230 using one or more of manually input information, information from switches the rail vehicle 230 has passed over, location determination systems utilizing GPS, RFID tags, or the like. The rail vehicle 230 may also utilize an onboard database describing or depicting the layout of the transportation network 200 or portions thereof. The remote crossing module 220 is configured to use the track identification information to suppress or inhibit automatic activation of the crossing gates 222, 224 only for track 212, and not for other tracks or sub-routes. Thus, if a different vehicle approaches on a different track, the crossing gates 222, 224 may be activated as appropriate based on the other vehicle's position.

For example, in the illustrated embodiment, as the rail vehicle 240 enters the approach 205, the remote crossing module 220 is configured to identify the rail vehicle 240 as traveling on a different track (e.g., track 214) than the track 212 for which an inhibit request (or requests) corresponding to the rail vehicle 230 has been received. Thus, the remote crossing module 220 may override or ignore the received inhibit request and instead activate the crossing gates 222, 224, avoiding a dangerous situation where the rail vehicle 240 may have passed through the crossing 208 without the crossing gates 222, 224 being activated. After the rail vehicle 240 has passed beyond the approach 204 or island 202, if the rail vehicle 230 is still approaching the station 250 or stopped at the station 250 and if an appropriate inhibit request has been received from the rail vehicle 230, the remote crossing module 220 may de-activate the warning (e.g., raise one or more crossing gates). Once the rail vehicle 230 is ready to leave the station 250, the rail vehicle 230 may send a release request to the remote crossing module 220 similar to the discussion above in connection with FIG. 1.

In one example scenario, the crossing gates 222, 224 may still be activated (e.g., lowered) responsive to the presence of the rail vehicle 240 passing through the approach 205 and/or island 202 when the rail vehicle 230 is ready to leave the station. In such a scenario, the rail vehicle 230 may transmit a release request to the remote crossing module 220 while the crossing gates 222, 224 are already activated. In various embodiments, if the remote crossing module 220 receives a release request while the crossing gates 222, 224 are already lowered, the remote crossing module 220 may maintain the crossing gates 222, 224 in an activated (e.g., lowered) condition and transmit an acknowledgement message to the rail vehicle 230 including information indicating that an immediate departure is permissible.

Figure 3:
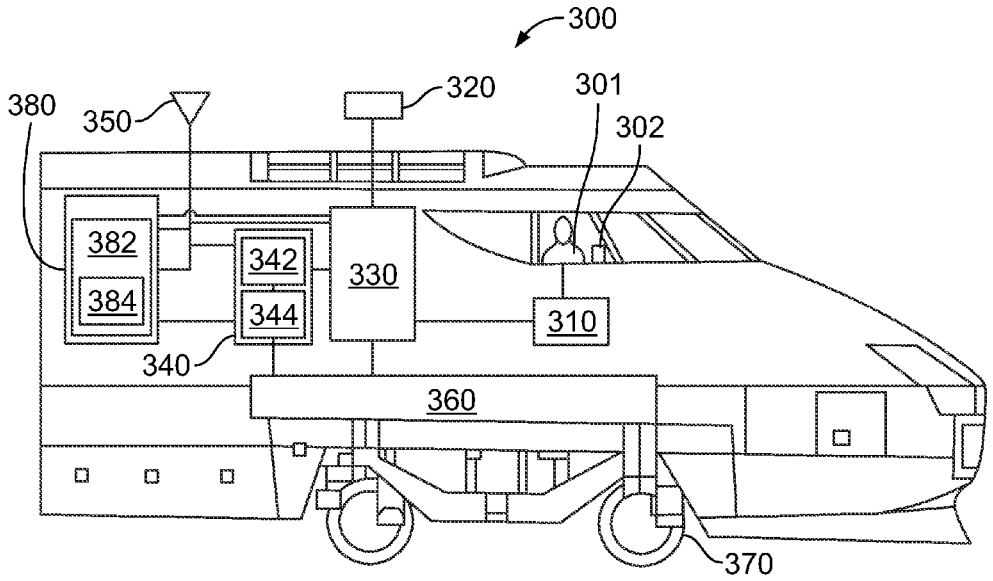
FIG. 3 is a schematic view of a vehicle system in accordance with an embodiment.

FIG. 3 provides a schematic view of a vehicle system 300 formed in accordance with an embodiment. The vehicle system 300 may include, for example, a rail vehicle consist including rail vehicle units (e.g., locomotives and non-powered units). The vehicle system 300 of the illustrated embodiment includes a display module 302, a manual input module 310, an automatic input module 320, an automatic control module 330, a trip planning control module 340, an antenna 350, a propulsion system 360, wheels 370, and a station determination module 380. Generally speaking, in the depicted embodiment, the trip planning control module 340 is configured to plan a trip and to provide control messages, either to an operator and/or directly to the propulsion system 360, to propel the vehicle system 300 along a trip or mission. The propulsion system 360 may include one or more motors and one or more brakes, with the control messages configured to cause the propulsion system to engage in braking or motoring activities in accordance with a trip plan. The automatic control system 330 may be configured to operate in accordance with a PTC system. In the illustrated embodiment, the automatic control system 330 is configured to override the trip planning control module 340 and/or an operator control, for example, to stop or slow the vehicle system 300 in accordance with a rule, for example a speed limit, or a safety condition such as a lockout or circumstance where another vehicle occupies a segment of a route the vehicle system 300 would otherwise enter pursuant to a command by the trip planning control module 340 and/or operator control. The antenna 350 is configured for communication between the vehicle system 300 and one or more off-board systems, such as, for example, wayside stations (e.g., remote crossing module 120, 220) and/or central scheduling systems and/or other vehicles traversing a transportation network. The rail vehicle system 300 is depicted as a single powered rail vehicle unit for ease of depiction. Other vehicle systems, including rail vehicle consists, may be employed in other embodiments.

The display module 302 is configured to provide information to an operator 301, and the manual input module 310 is configured to receive information from the operator 301. The display module 302 may include one or more of a screen, lights, speaker, bell, or the like configured to convey information to an operator. For example, the display module 302 may include a screen that displays a permissible departure time and/or a countdown to a permissible departure time.

The manual input module 310 is configured to obtain manually input information including manually input location information. The manually input location information may be used alone or in conjunction with automatically input location information by the station determination module 380 to determine track identification information for the rail vehicle system 300. The manually input information may correspond to information obtained via operator observation from one or more sources. For example, the manually input information may be obtained from a sign or other object configured to convey position information and mounted, hung, or otherwise disposed proximate to a track or route. The manually input information may also include, for example, an indication of an upcoming stop at a station and/or a request to depart a station at which the vehicle system 300 is stopped.

The automatic input module 320 is configured to automatically obtain (e.g., without operator intervention) location information and/or timing information. The automatically obtained information may correspond to a particular route or track (e.g., automatically obtained information may describe a change in particular track being traversed due to the activation of a switch); a location along a track or route (e.g., information from a GPS detector giving a geographic position or identifying a segment of a track or route where the vehicle system 300 is located); and/or a direction (e.g. information from a GPS detector taken at different times with the vehicle system 300 in motion used to determine a trend or direction). The automatic input module 320 in the illustrated embodiment may also provide absolute time information to be utilized, for example, by the station determination module 380 and/or the automatic control system 330. For example, the automatic input module may include timing information from a GPS system or other system synchronized to a common time reference as one or more remote crossing modules. Automatically obtained information may also include speed information. Thus, the vehicle system 300 may include one or more of a GPS detector, an axle tachometer, inertial system, LORAN system, or the like. Further, the automatic input module 320 may include a receiver configured to receive location information from a transponder associated with a track or route on which the vehicle system 300 is disposed, for example a transponder associated with a wayside station, a switch, and/or a signal. For example, a message associated with a switch may provide information regarding a change from one track or route to another due to a position of the switch, or a message from a wayside station may include information corresponding to a vehicle's position along a route or track based on the location of the wayside station. The automatic detection module 320 in various embodiments thus may detect information corresponding to the position of the vehicle system 300 along the length of a given route and/or a particular sub-route on which the vehicle system 300 is traveling.

In the illustrated embodiment, the automatic control module 330 is configured to control the vehicle system 300 to conform to a set of regulations along a route during a trip or mission performed by the vehicle system 300. The automatic control module 330 may be configured to control the vehicle system 300 pursuant to a PTC system. The regulations may be location-based regulations. The regulations may be based on a rule or requirement of operation for a particular route segment, such as a speed limit or the like. The regulations may also correspond to a condition of a track or related componentry, such as if a route segment is occupied by a different vehicle, if a switch is misaligned, or the like. The automatic control module 330 may use location information provided by the manual input module 310 and the automatic input module 320 to determine appropriate automatic control activities. The automatic control module 330, when enabled, may override or interrupt a previously planned controlled activity (e.g., a control activity previously determined by the trip planning control module 340) and/or an operator controlled activity.

Further, in the illustrated embodiment, the automatic control module 330 is configured to control the vehicle system 300 as the vehicle system 300 prepares to depart and/or departs from a station within range of a track detection system of a crossing warning system. For example, once the vehicle system 300 is ready to depart, a release request message may be transmitted to a remote crossing module. The remote crossing module may then determine an appropriate departure time from the station by the vehicle system 300 that will allow a predetermined warning time between the activation of a crossing warning system and the arrival of the vehicle system 300 at the station, and communicate the departure time to the vehicle system 300. The automatic control module 330 may then control the vehicle system 300 accordingly. For example, the automatic control module 330 may enforce the departure time by prohibiting any attempts (e.g., as called for by a trip plan or by operator input) to depart the station before the departure time. As another example, the automatic control module 330 may prohibit departure from the station before a permissible departure time message has been received from the remote crossing module. As still another example, after an inhibit request has been sent, the automatic control module 330 may enforce the stop corresponding to the inhibit request, and ensure that the stop is made by the vehicle system 300. As one more example, the automatic control module 330 may also limit or otherwise control the speed and/or acceleration of the vehicle system 300 as the vehicle system 300 leaves a station to prevent a premature (e.g., before a predetermined warning activation time) arrival at a crossing.

The trip planning control module 340 of the vehicle system 300 may be configured to receive a schedule sent by an off-board scheduling system. The trip planning control module 340 may include a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as a memory 344. The memory 344 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

The trip planning control module 340 may include one or more modules that perform various operations. The control module 342, along with other modules (not shown) may be included in the controller. The modules may include hardware and/or software systems that operate to perform one or more functions, such as the controller and one or more sets of instructions. Alternatively, one or more of the modules may include a controller that is separate from the controller, or may be combined to form a combined module.

The trip planning control module 340 may receive a schedule from a scheduling system. The schedule may include, among other things, an identification of stations at which the vehicle system 300 is to stop during a mission or trip. The trip planning control module 340 may be operatively coupled with, for example, the antenna 350 to receive an initial and/or modified schedule from the scheduling system. In an embodiment, the schedules are conveyed to the control module 342 of the trip planning control module 340. In an embodiment, the control module 342 may be disposed off-board the vehicle system 300 for which the trip plan is formed. For example, the control module 342 may be disposed in a central dispatch or other office that generates the trip plans for one or more vehicles.

In the illustrated embodiment, the control module 342 receives the schedule sent from the scheduling system and generates a trip plan based on the schedule. The trip plan may include throttle settings, brake settings, designated speeds, or the like, of the vehicle system 300 for various sections of a scheduled trip or mission of the vehicle system 300 to the scheduled destination location. The trip plan may be generated to reduce the amount of fuel that is consumed by the vehicle system 300 as the vehicle system 300 travels to the destination location relative to travel by the vehicle system 300 to the destination location when not abiding by the trip plan.

In order to generate the trip plan for the vehicle system 300, the control module 342 can refer to a trip profile that includes information related to the vehicle system 300, information related to a route over which the vehicle system 300 travels to arrive at the scheduled destination, and/or other information related to travel of the vehicle system 300 to the scheduled destination location at the scheduled arrival time, including identification of stations at which the vehicle system 300 may stop during the mission. The information related to the vehicle system 300 may include information regarding the fuel efficiency of the vehicle system 300 (e.g., how much fuel is consumed by the vehicle system 300 to traverse different sections of a route), the tractive power (e.g., horsepower) of the vehicle system 300, the weight or mass of the vehicle system 300 and/or cargo, the length and/or other size of the vehicle system 300, the location of powered units in the vehicle system 300, or other information. The information related to the route to be traversed by the vehicle system 300 can include the shape (e.g., curvature), incline, decline, and the like, of various sections of the route, the existence and/or location of known slow orders or damaged sections of the route, and the like. Other information can include information that impacts the fuel efficiency of the vehicle system 300, such as atmospheric pressure, temperature, and the like.

The trip plan is formulated by the control module 342 based on the trip profile. For example, if the trip profile requires the vehicle system 300 to traverse a steep incline and the trip profile indicates that the vehicle system 300 is carrying significantly heavy cargo, then the control module 342 may form a trip plan that includes or dictates increased tractive efforts for that segment of the trip to be provided by the propulsion subsystem 360 of the vehicle system 300. Conversely, if the vehicle system 300 is carrying a smaller cargo load and/or is to travel down a decline in the route based on the trip profile, then the control module 342 may form a trip plan that includes or dictates decreased tractive efforts by the propulsion subsystem 360 for that segment of the trip. In an embodiment, the control module 342 includes a software application or system such as the Trip Optimizer™ system provided by General Electric Company. The control module 342 may directly control the propulsion system 360 and/or may provide prompts to an operator for control of the propulsion system 360. As discussed above, control activities planned by the trip planning control module 340 may be overridden by control activities called for by the automatic control module 330. Further, the trip planning control module 340 may modify the trip plan based on control activities called for by the automatic control module 330 (e.g., a speed on a later portion of the trip may be increased to account for an enforced stop at a station that lasts longer than originally called for by the trip plan).

The station determination module 380 may include a memory 382 including a database 384. The station determination module 380 is configured to determine an upcoming stop of the rail vehicle system 300 at an upcoming station and to communicate an inhibit request corresponding to the stop at the station to a remote crossing module associated with the crossing. For example, the station determination module 380 may obtain location information describing or corresponding to a position along a route of the rail vehicle system 300 from the automatic input module 320, and identify an upcoming station at which the vehicle system 300 is to stop. The identification of the upcoming station may be determined using information from a trip plan, information stored in the database 384, information transmitted from the station or from a remote crossing module or the like. The station determination module 380 may also determine if the station is within range of a track detection system, and, if so, may transmit an inhibit request message (or messages) before the vehicle system 300 comes within range of the track detection system. After the vehicle system 300 stops at the station, the station determination module 380 may determine that the vehicle system 300 is ready to depart the station. The determination may be based on one or more of a user input (e.g., an operator pressing a button or otherwise making an entry corresponding to a desired departure), information from a trip plan, an amount of dwell time spent at the station, or the like.

Figure 4:
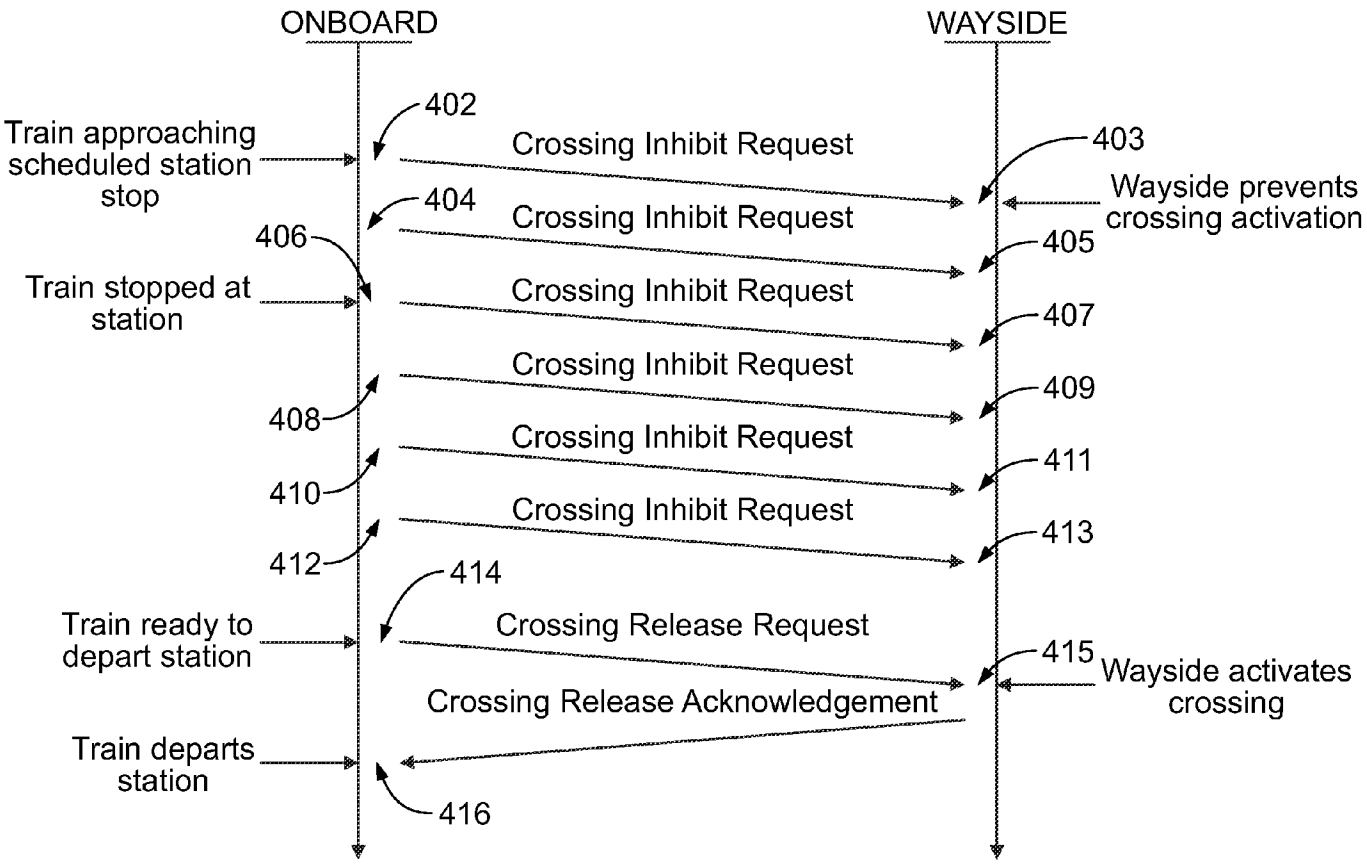
FIG. 4 is a timeline of an embodiment for communicating messages between a vehicle system and a remote crossing module.

As discussed herein, in various embodiments, repeated inhibit requests may be transmitted from a vehicle system approaching a stop at a station and/or stopped at a station. FIG. 4 illustrates a timeline of an embodiment. At 402, a vehicle system (e.g., a train) is approaching a station at which the train is to stop. In the illustrated embodiment, the station is disposed within range of a track detection system utilized by wayside equipment to operate a crossing warning. At 402, the train sends a first crossing inhibit request to the wayside equipment, and the first crossing inhibit request is received by the wayside equipment at 403. The first inhibit request may be sent so that it is received by the wayside equipment before the train enters the range of the track detection system. Responsive to the receipt of the first crossing inhibit request, the wayside equipment at 403 prevents activation of the crossing otherwise called for by the presence and/or movement of the train within range of the track detection system.

To help prevent activation of the crossing being inappropriately suppressed in the event of failed communication between the train and the wayside equipment, for example, the wayside equipment may be required to receive an inhibit request before expiration of a periodic timeout period. Accordingly, the train may transmit crossing inhibit requests at a repeated interval that is less than the periodic timeout period. At 404, as the train continues to approach the station at which the train will stop, a second crossing inhibit request is sent, and at 405 the second crossing inhibit request is received, resulting in continued prevention of the activation of the crossing warning system otherwise called for by the presence and/or movement of the train.

At 406, the train arrives at the station and stops at the station. Also, a third crossing inhibit request is sent, and received by the wayside equipment at 407, resulting in continued prevention of the activation of the crossing warning system. While the train remains stopped at the station, subsequent inhibit request are sent at 408, 410, 412 and received at 409, 411, and 413, respectively, resulting in the continued prevention of activation of the crossing warning system.

At 414, it is determined that the train is ready to depart the station. Thus, at 414 a crossing release request is transmitted from the train to the wayside equipment. At 415, the wayside equipment receives the crossing release request, activates the crossing warning system and sends an acknowledgement message to the train. The acknowledgement message in the illustrated embodiment indicates a time at which the train is permitted to depart the station such that the train will not arrive at the crossing until the crossing warning system has been activated for a predetermined amount of time. At 416, the train receives the acknowledgment message. In the illustrated embodiment, the time of receipt of the message coincides with the permitted departure time, and the train departs the station at 416 upon receipt of the acknowledgement message. In other embodiments, for example where a longer warning time may be required, where the train is capable of greater speed and/or acceleration, where the station is closer to the crossing, or the like, the departure time may be set some later than the time of receipt of the acknowledgement, and the train may be required to wait at the station for some amount of time before departing.

Figure 5:
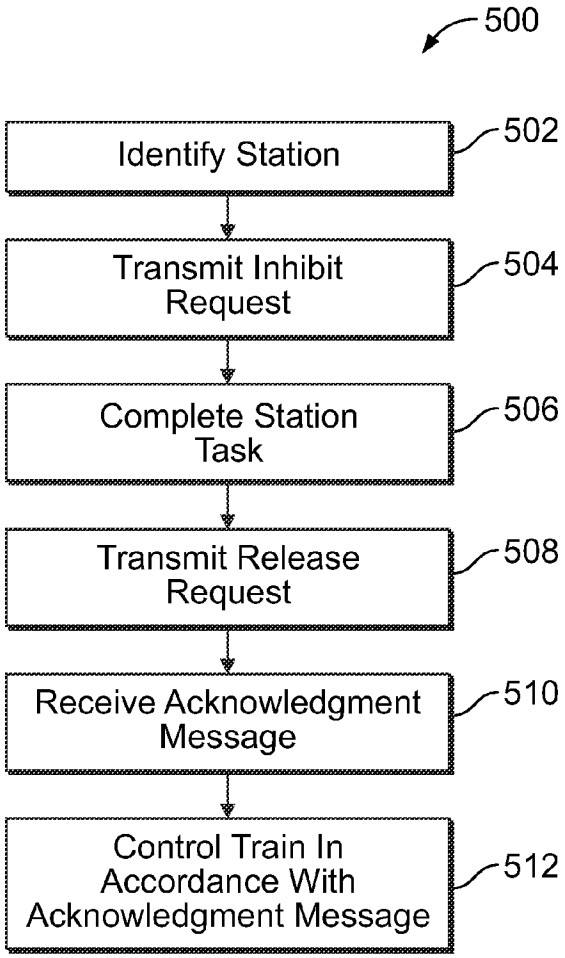
FIG. 5 is a flowchart of an embodiment for operating a rail vehicle approaching a crossing and/or station.

FIG. 5 is a flowchart of an embodiment of a method 500 for operating a rail vehicle approaching a crossing and/or station. The method 500 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 502, an upcoming station at which a vehicle will stop is determined. The determination or identification of the station may be made based on a trip plan, database, profile, or schedule. The identification may be made, in various embodiments, based on operator input, dispatcher input, or other user identification of the station. As one more example, the identification may be provided by a message from a station or wayside equipment indicating or requiring a stop at the station. In various embodiments, it may be determined if the station is within the range of a track detection system associated with a crossing.

At 504, an inhibit request is transmitted to a remote crossing module to prevent operation of a crossing warning system otherwise called for by the entry of the vehicle into the range of the crossing warning system. Responsive to receipt of the inhibit request, the remote crossing module prevents activation of the crossing warning system. The inhibit request in the illustrated embodiment is transmitted before the vehicle enters the range. In various embodiments, the remote crossing module may have a timeout period and activate the crossing warning system if an inhibit request is not received within the timeout period, with the vehicle transmitting repeated inhibit requests to satisfy the timeout period. Repeated inhibit requests may be transmitted while the vehicle approaches the station, arrives at the station, and is stopped at the station.

At 506, a station task is completed. For example, some passengers may disembark from the train while other passengers board the train. Completion of the task may be determined in some embodiments based on a predetermined dwell time at the station. In other embodiments, completion of the task may be determined by an operator (e.g., visual inspection confirming that no passengers are still boarding and/or disembarking from the train).

At 508, a release request is transmitted from the train to the remote crossing module. The release request is configured to inform the remote crossing module that the train is ready to depart the station. Responsive to receiving the release request, the remote crossing module may initiate a crossing warning activity and determine a permissible departure time for the train from the station and/or arrival time at the crossing to allow for sufficient time for activation of the crossing warning system. The remote crossing module may transmit an acknowledgement message to the train that confirms the receipt of the release request and/or informs the train of the permitted departure time.

At 510, the acknowledgement message is received by the train. At 512, the train is controlled in accordance with the acknowledgement message. For example, the train may be prohibited (e.g., by an automatic control module disposed onboard the train) from departing the station before the departure time is reached. Additionally or alternatively, the acceleration and/or speed of the train may be limited or otherwise controlled to provide a desired time of arrival at the crossing (e.g., to match a consistent predetermined warning time for activation of the crossing warning system before the arrival of the train at the crossing). Further, in various embodiments, a warning, indication, and/or prompt may be provided to an operator indicating whether or not the departure time has been reached. If the permitted departure time has not been reached, an order or request by the operator to depart the station may be overridden or ignored. If the permitted departure time has arrived, an audible and/or visible signal may be provided to the operator indicating that departure is permitted.

Figure 6:
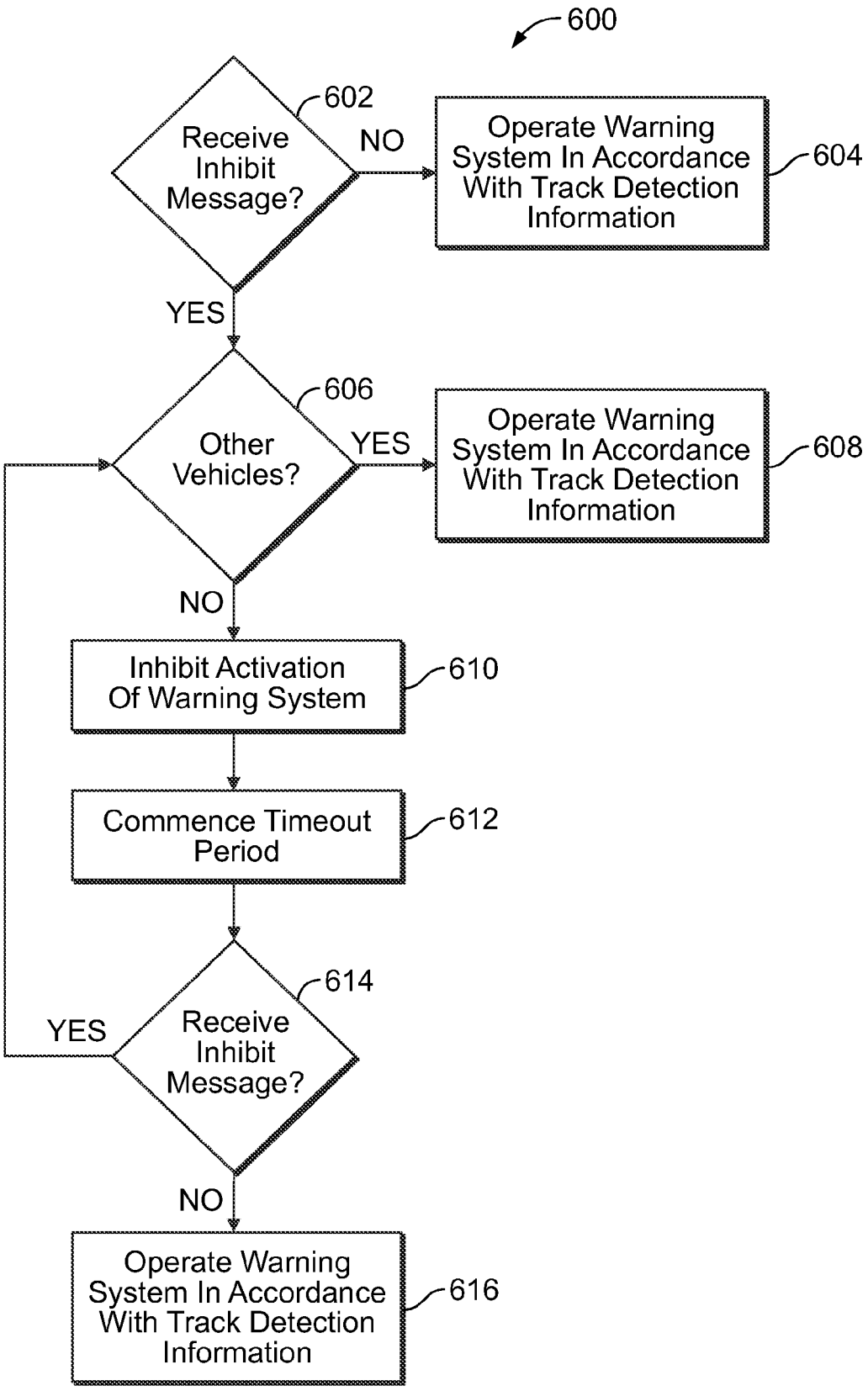
FIG. 6 is a flowchart of an embodiment for operating a crossing warning system.

FIG. 6 is a flowchart of an embodiment of a method 600 for operating a crossing warning system. The method 600 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 602, it is determined whether or not a remote crossing module has received an inhibit request message from a vehicle approaching a range of a detection system associated with the remote crossing module. The inhibit request is configured to suppress activation of a crossing warning system operated by the remote crossing module. In some embodiments, the inhibit request may include identification information and be configured to suppress activation of the crossing warning system only for a particular vehicle traveling on a specified track. The remote crossing module is configured to use information from the track detection system to operate a crossing warning system. For example, in some embodiments, the track detection system is configured as an occupancy detection system, and the remote crossing module is configured to activate the crossing warning when the track detection system indicates occupancy by a vehicle within the range, unless such an activation is suppressed by an appropriate inhibit request. If a valid inhibit request message has been received, the method proceeds to 606. If not, the method proceeds to 604.

At 604, if no inhibit request message has been received (or if no valid inhibit request message has been received), the remote crossing module operates the crossing warning system in accordance with information obtained from the track detection system. For example, if the track detection system is an occupancy detection system and a vehicle is identified as occupying the track within the range of the track detection system, then the remote crossing module would activate the crossing warning system.

At 606, in various embodiments, it is determined if any other vehicles other than the vehicle that transmitted the inhibit request message are approaching or near the crossing. For example, the remote crossing module may receive information from the track detection system indicates that a warning activation is appropriate. The remote crossing module may then determine, for example using identification information from the inhibit request message, if the information corresponds to the vehicle that sent the inhibit request, or to a different vehicle. If the information corresponds to a different vehicle, the method proceeds to 608, and the crossing warning system is operated by the remote crossing module in accordance with the information obtained from the track detection system. If the information corresponds to a vehicle that sent a valid inhibit request message, the method proceeds to 610.

At 610, the activation of the crossing warning system otherwise called for by information from the track detection system is inhibited. At 612, a timeout period is commenced. To continue inhibition or suppression of the crossing warning system, the remote crossing module may require a vehicle approaching a station or stopped at a station to continue sending periodic repeated inhibit request messages. In various embodiments, the remote crossing module utilizes the timeout period as protection against an overly long or otherwise inappropriate inhibition of activation of a crossing warning that may be caused, for example, by a failure in communication between the remote crossing module and a vehicle that previously sent an inhibit request. At 614, it is determined if a subsequent inhibit request has been received during the timeout period. If a valid inhibit request has been received, the method returns to 606. If a valid inhibit request is not received within the timeout period, then the method proceeds to 616, and the crossing warning system is operated in accordance with the information obtained from the track detection system.

Figure 7:
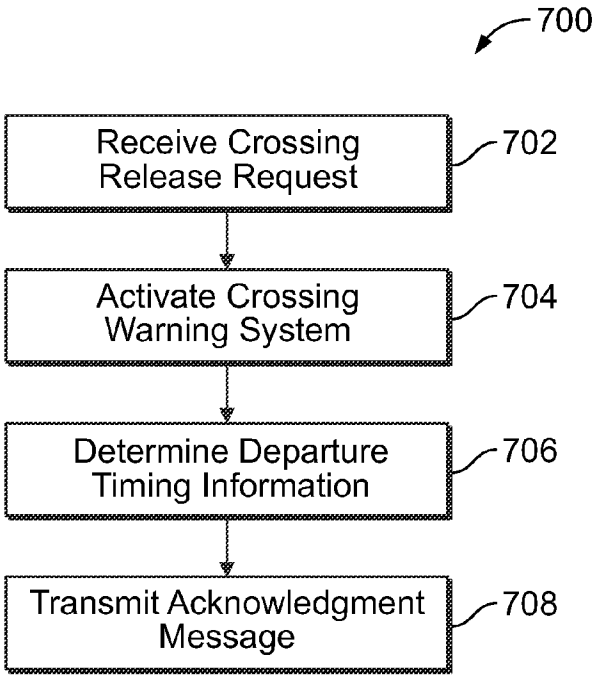
FIG. 7 is a flowchart of an embodiment for operating a crossing warning system.

FIG. 7 is a flowchart of an embodiment of a method 700 for operating a crossing warning system. For the embodiment depicted in FIG. 7, the method 700 begins with a vehicle stopped at a station within a range of a track detection system utilized by a remote crossing module configured to operate a crossing warning system. Further, for the embodiments depicted in FIG. 7, a valid inhibit request (see FIG. 6 and related discussion) has been received by the remote crossing module such that the crossing warning system is not activated while the vehicle is stopped at the station and the method 700 commences. The method 700 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 702, a crossing release request is received by the remote crossing module from the vehicle stopped at the station. For example, an onboard control system of the vehicle may prevent the vehicle from leaving the station until a release from the station is granted by the remote crossing module. To obtain the release, the crossing release request is transmitted by the vehicle to the remote crossing module when it is determined (e.g., via a timer, from an operator input, or the like) that the vehicle is ready to leave the station.

At 704, responsive to receiving the crossing release request, the crossing warning system is activated by the remote crossing module. Activation of the crossing warning system may include, for example, one or more of sounding an alarm, providing a visual display such as flashing lights, or placing an impediment (such as lowering a gate) to traffic that may attempt to cross the track along a different route.

At 706, departure timing information is determined, for example by one or more processing units disposed within the remote crossing module. In some embodiments, the departure timing information may include a permitted departure time corresponding to a time when the vehicle is permitted to depart the station, with the departure time determined to allow enough time for the crossing warning system to be activated for a predetermined amount of time before the vehicle arrives at the crossing. The departure time may be determined based on, for example, the length of a predetermined warning time, the distance from the station at which the vehicle is stopped to the crossing, and/or the maximum speed and/or acceleration achievable by the vehicle between the station and the crossing. In some embodiments, the departure timing information may include a permitted crossing arrival time corresponding to a time when the vehicle is permitted to arrive at the crossing.

At 708, an acknowledgement message is transmitted from the remote crossing module to the vehicle stopped at the station from which the crossing release request was received. The acknowledgement message provides confirmation to the vehicle that the crossing release request was received. In various embodiments, the acknowledgment message may also include information indicating whether departure is permitted or not permitted, or a time at which departure is permitted. In the illustrated embodiment, the acknowledgment message includes departure timing information, for example as determined at 706. The departure timing information may be used in various embodiments by a control system disposed onboard the vehicle to prevent premature arrival (e.g., before a specified amount of warning time has elapsed) of the vehicle at the crossing. For example, in various embodiments in which the departure timing information includes a permitted departure time, an onboard control system may override any attempts (e.g., by an operator) to leave the station before the permitted departure time. As another example, in various embodiments in which the departure timing information includes a permitted crossing arrival time, an onboard control system may control the vehicle (e.g., by regulating the time of departure and/or speed of the vehicle) so that the vehicle arrives at the crossing at the permitted crossing arrival time. In various embodiments, the acknowledgement and departure timing information may be sent as portions of two or more messages.

In an embodiment, a system includes a determination module and a communication module. The determination module is configured to be located onboard a first vehicle configured to travel along a first route. The first route includes a crossing corresponding to an intersection of the first route with a second route. The determination module is configured to be communicatively coupled with a remote crossing module that is configured to control a warning system to impede travel of a second vehicle along the second route through the crossing when the first vehicle is proximate to the crossing on the first route. In various embodiments, with respect to the operation of the warning system to impede travel through the crossing, the first vehicle may be understood to be proximate the crossing when the first vehicle is within a specified distance or time (e.g., 30 seconds) of a crossing. For example, a standard or regulation may prescribe a time for which a crossing warning is to be operated before a vehicle arrives at a crossing, and the specified distance or time may correspond to the prescribed time (e.g., may be the same as the prescribed time, or may be a longer period of time to provide a margin of error). The determination module is configured to identify an upcoming stop at a station within a range of a track detection system associated with the remote crossing module. The communication module is configured to communicatively couple the determination module to the remote crossing module, and is configured to transmit one or more inhibit request messages to the remote crossing module. The one or more inhibit request messages are configured to prevent the remote crossing module from activating the warning system when the first vehicle is approaching or stopped at the station.

In another aspect, the communication module is configured to transmit the inhibit request messages spaced a predetermined amount of time apart while the first vehicle is at least one of approaching the station or stopped at the station. The predetermined amount of time may be configured to occur at least twice during a timeout period of the remote crossing module.

In another aspect, the communication module may be configured to transmit a crossing release request to the remote crossing module before the first vehicle departs the station. In various embodiments, the communication module may be configured to transmit the crossing release request at least one of pursuant to a manual input by an operator or automatically by the first vehicle. It may be noted that, in various embodiments, the communication module may be configured to transmit the crossing release request, even if the communication module has not transmitted or is not configured to transmit the inhibit request. For example, in an example scenario where certain track detection circuits are employed (e.g., motion prediction circuits), a crossing warning may activate while the first vehicle is approaching the station, but the crossing warning might recover or de-activate while the first vehicle is stopped at the station. Thus, the crossing release request may be employed to help prevent premature departure of the first vehicle from the station and/or premature arrival at the crossing.

Alternatively or additionally, the communication module may be configured to receive a crossing acknowledgement message from the remote crossing module. The system may further include a control module configured to control operation of the first vehicle in accordance with information included in the crossing acknowledgement message. Further, the control module may be configured to prevent departure from the station by the first vehicle until a departure time specified in the crossing acknowledgement message. In various embodiments, the system may include a display module configured to provide a visual display to an operator corresponding to the departure time.

In an embodiment, a system includes a remote crossing module configured to be disposed along a first route along which a first vehicle is configured to travel. The first route includes a track and a crossing corresponding to an intersection of the first route with a second route. The remote crossing module is configured to control a warning system configured to impede travel of a second vehicle along the second route through the crossing when the first vehicle is proximate to the crossing on the first route. The remote crossing module includes an automatic closure module and a communication module. The automatic closure module is configured to activate the warning system configured to impede travel of the second vehicle along the second route using information obtained from a track detection system configured to detect signals sent via the track. The communication module is configured to communicatively couple the remote crossing module to the first vehicle, and to receive one or more inhibit request messages from the first vehicle corresponding to a stop by the first vehicle at a station disposed within a range of the track detection system. The remote crossing module is configured to prevent activation of the warning otherwise indicated by the information obtained from the track detection system responsive to receiving the one or more inhibit request messages.

In another aspect, the communication module is configured to receive a crossing release request from the first vehicle, the system further comprising a determination module configured to determine, responsive to the receipt of the crossing release request, a departure time for the first vehicle from the station corresponding to a time at which the remote crossing module will have sufficient time to activate the warning, wherein the communication module is configured to transmit an acknowledgement message of the receipt of the crossing release request to the first vehicle. The acknowledgement message includes departure timing information corresponding to the determined departure time. It may be noted that, in various embodiments, the communication module may be configured to receive the crossing release request, even if the communication module has not received or is not configured to receive the inhibit request. For example, in an example scenario where certain track detection circuits are employed (e.g., motion prediction circuits), a crossing warning may activate while the first vehicle is approaching the station, but the crossing warning might recover or de-activate while the first vehicle is stopped at the station. Thus, the crossing release request may be employed to help prevent premature departure of the first vehicle from the station and/or premature arrival at the crossing.

In another aspect, the automatic closure module is configured to receive information from a track occupancy detection system and to impede travel along the second route through the crossing based on a track occupancy.

In another aspect, the automatic closure module is configured to receive information from a crossing predictor detection system including a shunt positioned along the first route, and the automatic closure module configured to impede travel along the second route through the crossing based on a speed and location of the first vehicle determined using the information from the crossing predictor detection system.

An embodiment relates to a method that includes determining, at one or more processing units disposed onboard a first vehicle configured to travel along a first route, an upcoming stop at a station that is disposed within a range of a track detection system of a crossing. The crossing corresponds to an intersection of the first route with a second route. The method also includes communicating one or more inhibit request messages to a remote crossing module disposed along the first route proximate the crossing. For example, responsive to the determining of an upcoming stop, one or more inhibit request messages may be communicated to the remote crossing module. The one or more inhibit request messages are prepared at the one or more processing units, and are configured to prevent activation of a crossing warning activity at the crossing otherwise called for by information from the track detection system. The remote crossing module is configured to impede travel of a second vehicle along the second route through the crossing based on the information from the track detection system.

In an embodiment of the method, the method includes sending the inhibit request messages spaced apart at times less than a timeout period of the remote crossing module.

In an embodiment of the method, the method includes sending a crossing release request to the remote crossing module. The crossing release request may be configured to request permission for the first vehicle to depart the station after the first vehicle has stopped at the station. In various embodiments, the crossing release request is sent responsive to an operator input or automatically by the first vehicle. It may be noted that, in various embodiments, the crossing release request may be sent even if the inhibit request has not been sent (e.g., if there were a problem encountered in the communication of the inhibit request). For example, in an example scenario where certain track detection circuits are employed (e.g., motion prediction circuits), a crossing warning may activate while the first vehicle is approaching the station, but the crossing warning might recover or de-activate while the first vehicle is stopped at the station. Thus, the crossing release request may be employed to help prevent premature departure of the first vehicle from the station and/or premature arrival at the crossing.

In an embodiment, the method may include obtaining control information from an acknowledgement from the remote crossing module of the crossing release request, and controlling the first vehicle in accordance with the control information. In various embodiments, the control information may include a departure time. Controlling the first vehicle in accordance with the control information may include preventing, by a control module disposed onboard the first vehicle, departure from the station before the departure time.

In an embodiment of the method, the reference time is a time at which the first vehicle will enter the crossing.

In an embodiment of the method, the reference time is a time at which a gate corresponding to the crossing is to be closed.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" of the presently described inventive subject matter are not intended to be interpreted as excluding the existence of additional embodiments that also incorporate the recited features. Moreover, unless explicitly stated to the contrary, embodiments "comprising," "comprises," "including,"

"includes," "having," or "has" an element or a plurality of elements having a particular property may include additional such elements not having that property.

What is claimed is:

1. A system comprising:

a determination module configured to be located onboard a first vehicle configured to travel along a first route, the first route including a crossing corresponding to an intersection of the first route with a second route, the determination module configured to be communicatively coupled with a remote crossing module configured to control a warning system to impede travel of a second vehicle through the crossing along the second route when the first vehicle is proximate to the crossing on the first route, wherein the determination module is configured to identify an upcoming stop of the first vehicle at a station disposed along the first route and interposed between the first vehicle and the crossing within a range of a track detection system associated with the remote crossing module; and a communication module configured to communicatively couple the determination module to the remote crossing module, the communication module configured to transmit one or more inhibit request messages to the remote crossing module, the one or more inhibit request messages configured to prevent the remote crossing module from activating the warning system when the first vehicle is approaching or stopped at the station.

2. The system of claim 1, wherein the communication module is configured to transmit the inhibit request messages spaced a predetermined amount of time apart from each other while the first vehicle is approaching the station or stopped at the station.

3. The system of claim 2, wherein the predetermined amount of time is configured to occur at least twice during a timeout period of the remote crossing module.

4. The system of claim 1, wherein the communication module is further configured to transmit a crossing release request to the remote crossing module before the first vehicle departs the station, the crossing release request directing the remote crossing module to activate or re-activate the warning system.

5. The system of claim 4, wherein the communication module is configured to transmit the crossing release request at least one of pursuant to a manual input by an operator or automatically by the first vehicle.

6. The system of claim 4, wherein the communication module is configured to receive a crossing acknowledgement message from the remote crossing module, the system further comprising a control module configured to control operation of the first vehicle in accordance with information included in the crossing acknowledgement message.

7. The system of claim 1, wherein the communication module is configured to transmit the one or more inhibit request messages to the remote crossing module responsive to the upcoming stop at the station that is identified.

8. A system comprising:

a determination module configured to be located onboard a first vehicle configured to travel along a first route, the first route including a crossing corresponding to an intersection of the first route with a second route, the determination module configured to be communicatively coupled with a remote crossing module configured to control a warning system to impede travel of a second vehicle through the crossing along the second route when the first vehicle is proximate to the crossing on the first route, wherein the determination module is configured to identify an upcoming stop of the first vehicle at a station disposed along the first route and interposed between the first vehicle and the crossing within a range of a track detection system associated with the remote crossing module; and a communication module configured to communicatively couple the determination module to the remote crossing module, the communication module configured to transmit one or more inhibit request messages to the remote crossing module, the one or more inhibit request messages configured to prevent the remote crossing module from activating the warning system when the first vehicle is approaching or stopped at the station;

wherein the communication module is further configured to transmit a crossing release request to the remote crossing module before the first vehicle departs the station, the crossing release request directing the remote crossing module to activate a re-activate the warning system;

wherein the communication module is configured to receive a crossing acknowledgement message from the remote crossing module, the system further comprising a control module configured to control operation of the first vehicle in accordance with information included in the crossing acknowledgement message; and wherein the control module is configured to prevent departure of the first vehicle from the station until a departure time specified by the crossing acknowledgement message.

9. The system of claim 8, further comprising a display module configured to provide a visual display to an operator corresponding to the departure time.

10. The system of claim 8, wherein the communication module is configured to transmit the inhibit request messages spaced a predetermined amount of time apart from each other while the first vehicle is approaching the station or stopped at the station.

11. The system of claim 10, wherein the predetermined amount of time is configured to occur at least twice during a timeout period of the remote crossing module.

12. The system of claim 8, wherein the communication module is configured to transmit the crossing release request at least one of pursuant to a manual input by an operator or automatically by the first vehicle.

13. A system comprising:

a remote crossing module, the remote crossing module configured to be disposed along a first route along which a first vehicle is configured to travel, the first route comprising a track and a crossing corresponding to an intersection of the first route with a second route, the remote crossing module configured to control a warning system configured to impede travel of a second vehicle along the second route through the crossing when the first vehicle is proximate to the crossing on the first route, the remote crossing module comprising:

an automatic closure module configured to activate the warning system configured to impede travel of the second vehicle along the second route using information obtained from a track detection system configured to detect signals sent via the track; and a communication module configured to communicatively couple the remote crossing module to the first vehicle, the communication module configured to receive one or more inhibit request messages from the first vehicle corresponding to a stop by the first vehicle at a station disposed within a range of the track detection system, wherein the remote crossing module is configured to prevent activation of the warning system otherwise indicated by the information obtained from the track detection system responsive to receiving the one or more inhibit request messages.

14. The system of claim 13, wherein the communication module is configured to receive a crossing release request from the first vehicle, the system further comprising a determination module configured to determine, responsive to the receipt of the crossing release request, a departure time for the first vehicle from the station corresponding to a time at which the remote crossing module will have sufficient time to activate the warning system, wherein the communication module is configured to transmit an acknowledgement message of the receipt of the crossing release request to the first vehicle.

15. The system of claim 14, wherein the acknowledgement message includes departure timing information corresponding to the determined departure time.

16. The system of claim 13, wherein the communication module is configured to receive the inhibit request messages sent at spaced time intervals, and wherein the remote crossing module is configured to activate the warning system when indicated by the information obtained from the track detection system if no inhibit request messages are received within a predetermined timeout period.

17. The system of claim 13, wherein the automatic closure module is configured to receive information from a track occupancy detection system, the automatic closure module configured to impede travel along the second route through the crossing based on a track occupancy.

18. The system of claim 13, wherein the automatic closure module is configured to receive information from a crossing predictor detection system comprising a shunt positioned along the first route, the automatic closure module configured to impede travel along the second route through the crossing based on a speed and location of the first vehicle determined using the information from the crossing predictor detection system.

* * * * *